United States Patent [19]

Watanabe et al.

[11] Patent Number: 4,957,144

[45] Date of Patent: Sep. 18, 1990

[54] TACK-IN SYSTEM OF SHUTTLELESS LOOM

[75] Inventors: Tetsuji Watanabe, Tokyo; Hidetsugu Umezawa, Higashiyamato; Sigenori Tanaka, Tokyo, all of Japan

[73] Assignee: Nissan Motor Co., Ltd., Yokohama, Japan

[21] Appl. No.: 289,802

[22] Filed: Dec. 27, 1988

[30] Foreign Application Priority Data

| | | | |
|---|---|---|---|
| Dec. 28, 1987 | [JP] | Japan | 62-335468 |
| Mar. 31, 1988 | [JP] | Japan | 63-42014[U] |
| Jul. 4, 1988 | [JP] | Japan | 63-87941[U] |
| Jul. 6, 1988 | [JP] | Japan | 63-166953 |
| Jul. 22, 1988 | [JP] | Japan | 63-97047[U] |

[51] Int. Cl.[5] ..... D03D 47/48

[52] U.S. Cl. ..... 139/434; 139/194; 139/435.4

[58] Field of Search ..... 139/434, 194, 435.4, 139/116.1, 116.2, 453

[56] References Cited

U.S. PATENT DOCUMENTS

| | | | |
|---|---|---|---|
| 3,901,286 | 8/1975 | Vermeulen et al. | 139/194 X |
| 4,552,187 | 11/1985 | Bertsch et al. | 139/434 |
| 4,570,683 | 2/1986 | Griffith | 139/194 |
| 4,576,208 | 3/1986 | Steiner | 139/435 X |
| 4,715,410 | 12/1987 | Griffith | 139/434 |

FOREIGN PATENT DOCUMENTS

| | | | |
|---|---|---|---|
| 0291744 | 11/1988 | European Pat. Off. | 139/434 |
| 16-6398 | 11/1941 | Japan . | |
| 50-982 | 1/1975 | Japan . | |

*Primary Examiner*—Andrew M. Falik

*Attorney, Agent, or Firm*—Foley & Lardner, Schwartz, Jeffery, Schwaab, Mack, Blumenthal & Evans

[57] ABSTRACT

A tack-in system of an air jet loom, for forming a tack selvage at an edge section of a fabric. The tack-in system is comprised of a body of a tack-in device, which body is formed with a slit. The slit is located near an edge of an array of warp yarns. A weft yarn picked from a weft picking nozzle extends through the slit. The end section of the weft yarn picked and cut by a cutter is securely held in such a manner that at least a part thereof is located within the slit. A fluid jet nozzle is provided to eject a fluid jet from its opening which is located such that the fluid jet therefrom blows the weft yarn end section. The fluid jet from the fluid jet nozzle is so directed that the axis thereof crosses the cloth fell at an acute angle, thus securely pressing the weft yarn end section onto the cloth fell.

23 Claims, 26 Drawing Sheets

TACK-IN SYSTEM OF SHUTTLELESS LOOM

BACKGROUND OF THE INVENTION

1. Field of the Invention

This invention relates generally to improvements in a tack-in system, in a shuttleless loom, for tacking in the end section of a picked weft yarn under the action of an air stream from a tack-in nozzle thereby forming a tack selvage at the edge section of a woven fabric, and more particularly to such improvements to tighten the structure of the tack selvage.

2. Description of the Prior Art

Heretofore a variety of tack-in systems have been proposed and put into practical use. A typical one of those includes a fluid ejection or tack-in pipe disposed on the side of the edge of a warp yarn array as shown in the Japanese Publication No. 50-982. The fluid jet nozzle ejects fluid jet to cause the weft yarn end section (projected from the edge of a woven fabric) to be bent back or blown into the shed of the warp yarn during the next weft picking or at an initial period of beating-up operation, thus forming a tack selvage at the edge section of the woven fabric.

However, the air stream from the tack-in pipe is spread and dispersed and therefore inferior in direction. Therefore, the weft yarn end section bent back into the warp shed cannot be introduced to a desirable position. Moreover such an air stream is low in traction force for drawing the weft yarn end section to the warp shed. Accordingly, it is impossible to form a tight structure of the tack selvage.

SUMMARY OF THE INVENTION

It is an object of the present invention to provide an improved tack-in system of a shuttleless loom, which can form a tight structure of a tack selvage at the edge section of a woven fabric.

Another object of the present invention is to provide an improved tack-in system of a shuttleless loom, which can bend back and blow the end section of a picked weft yarn into the shed of warp yarns at a desired position.

According to the present invention, the tack-in system of a shuttleless loom is comprised of a device defining a slit located near the edge of an array of warp yarns. The weft yarn picked from a weft picking device extends through the slit. The end section of the weft yarn picked and cut by a cutter is held in such a manner that at least a part thereof is located within the slit. A fluid jet nozzle is provided to have an opening through which the fluid jet is ejected, which opening is located such that the fluid jet therefrom blows the weft yarn end section. The fluid jet from the fluid jet nozzle is so directed that the axis thereof crosses the cloth fell at an acute angle on a horizontal plane passing through the cloth fell.

Hence, by virtue of the relationship between the slit and the fluid jet nozzle, the weft yarn end section securely held in position is accurately bent back and blown into the shed of the warp yarns at a desired position, thereby being positively pressed onto the cloth fell. This forms a tight structure of a tack-in selvage.

BRIEF DESCRIPTION OF THE DRAWINGS

In the drawings, like reference numerals designate like elements and parts throughout all the figures, in which.

DETAILED DESCRIPTION OF THE INVENTION

Figure 1:
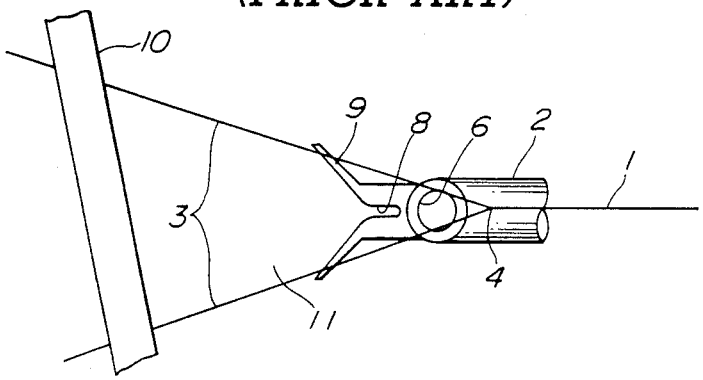
FIG. 1 (PRIOR ART)
FIG. 1 is a side view of an essential part of a conventional tack-in system for a shuttleless loom.
Figure 2:
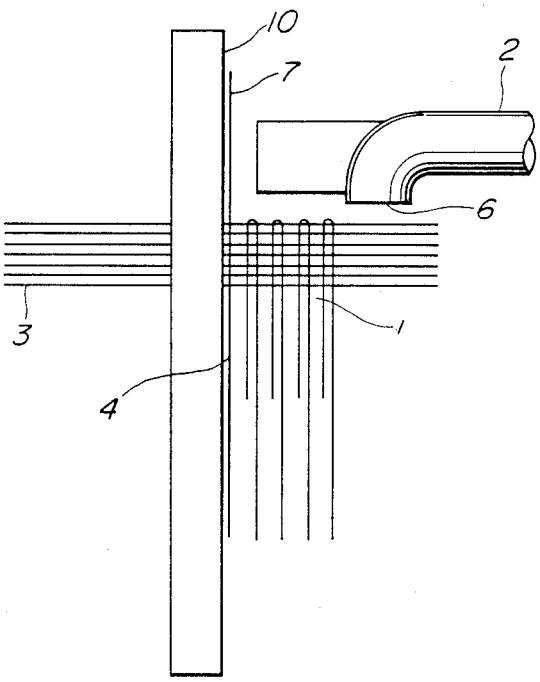
FIG. 2 (PRIOR ART)
FIGS. 2 and 3 are plan views illustrating the operation of the conventional tack-in system of FIG. 1.
Figure 3:
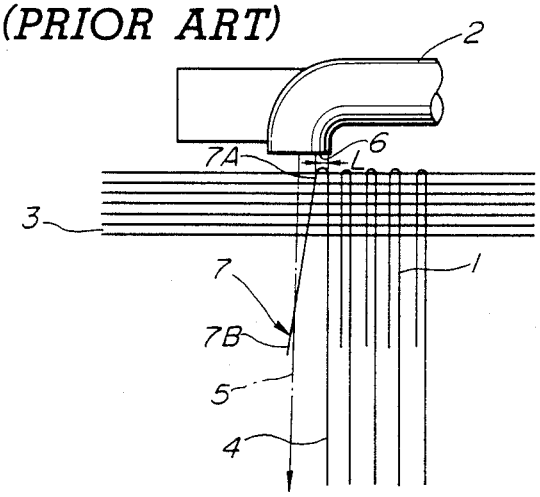
FIG. 3 (PRIOR ART)

To facilitate understanding of the present invention, a brief reference will be made to a conventional tack-in system of a loom as disclosed in Japanese Patent Publication No. 50-982, depicted in FIGS. 1 to 3. Referring to FIG. 1, the conventional tack-in system is shown having a fluid ejection pipe 2 which is disposed near the side edge of a woven fabric 1. Fluid ejection pipe 2 is arranged to be movable forward and rearward in parallel with warp yarn 3. Fluid ejection pipe 2 is formed with a tack-in opening 6 whose axis 5 is directed to the side of the woven fabric 1 or parallel with cloth fell 4. Fluid ejection pipe 2 is further provided with a weft guide member 9 located forward of the tack-in opening 6. Weft guide member 9 is formed with a yarn groove 8 which engages with and bends a weft yarn end section 7 projected from the edge of the woven fabric 1. With this arrangement, along with the backward movement (rightward movement in FIG. 1) of a reed 10, fluid ejection pipe 2 is moved backward, thereby guiding weft yarn end section 7 into yarn groove 8 under the action of weft guide member 9. As a result, weft yarn end section 7 is restrained at the generally central position of warp shed 11. Subsequently, when fluid ejection pipe 2 moves backward, weft yarn end section 7 is bent generally at right angles under the action of yarn groove 8 and the side surface of the fluid ejection nozzle 2. Immediately thereafter, the thus bent weft yarn end section 7 is further bent toward warp shed 11, thereby forming a tack selvage.

The following difficulties have been encountered in such a conventional tack-in system. Since axis 5 of tack-in opening 6 is set parallel with cloth fell 4, the tip end portion 7B of weft yarn end section 7 bent into the warp shed 11 is restrained by warp yarns 3 at a position remote from cloth fell 4 as compared with the base end portion 7A of weft yarn end section 7. This is supposed to be caused by the fluid ejection stream of the tack-in opening 6 which disperses toward reed 10 because no obstacle to this dispersement exists on the side of reed 10. Accordingly, restraint against weft yarn end section 7 is first made at a remote position, measured by a distance L from cloth fell 4, and thereafter successively moves toward the tip end portion 7B. Thus, the base end portion 7A of weft yarn end section 7 receives a bending force from the warp yarns 3 when the tip end portion 7B of weft yarn end section 7 has not yet been restrained by the warp yarns 3. Consequently, the tension of weft yarn end section 7 is overcome by that of the warp yarns 3 thereby drawing the side of the tip end portion 7B of weft yarn end section 7 toward the side of the base end portion 7A. This causes weft yarn end section 7 to be curved beyond a predetermined value, thereby decreasing the warp yarn tension at the tack selvage of woven fabric 1, thus forming a loosened tack selvage.

Figure 7:
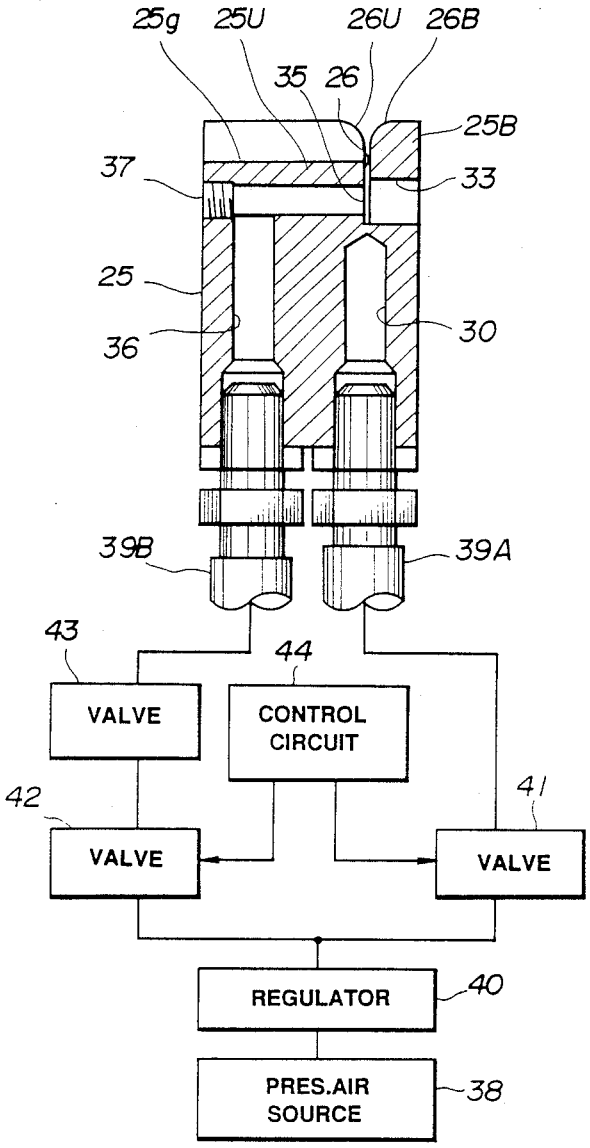
FIG. 7 is a cross-sectional view of the essential part of the tack-in system provided with a pneumatic control system.
Figure 8:
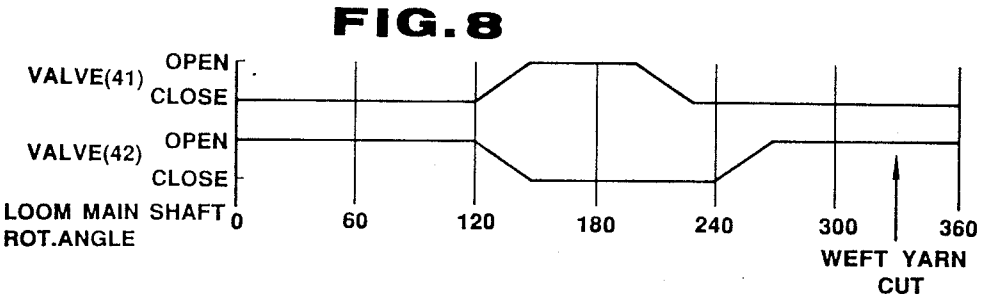
FIG. 8 is a timing chart showing timing of opening and closing of valves forming part of the pneumatical control system of FIG. 7.
Figure 9:
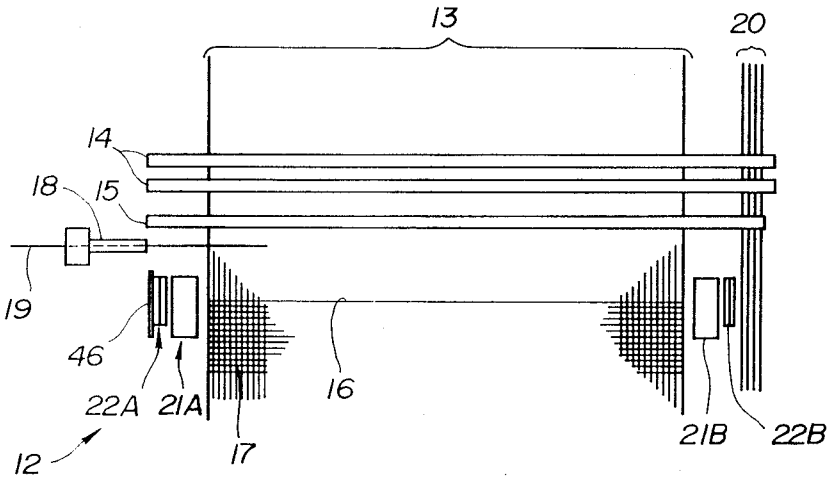
FIG. 9 is a schematic plan view of a shuttleless loom provided with the first embodiment tack-in system of FIG. 4.

In view of the above description of the conventional tack-in system, reference is now made to FIGS. 4 to 42, and more specifically to FIGS. 4 to 11, wherein a first embodiment of a tack-in system according to the present invention is illustrated by the reference numeral 12. In this embodiment, tack-in system 12 depicts a shuttleless loom such as an air jet loom. As shown in FIG. 9, the fluid jet loom comprises heald frames 14 for accomplishing shedding operation of warp yarns 13. A reed 15 is movably disposed between heald frames 14 and cloth fell 16 of woven fabric 17. A weft inserting nozzle 18 is provided to project therefrom weft yarn 19 into shed 49 of warp yarns 13 and arranged to be swingable together with reed 15 as one-piece. Weft yarn 19 picked through warp yarn shed 49, projects from the side edge of woven fabric 17 on the counter-weft picking side and reaches catch cords 20 for catching the projected end section 32 of picked weft yarn 19, thereby forming a tack selvage which will be separated from woven fabric 17. Cutters 21A, 21B are respectively disposed outside the side edges of woven fabric 17 in order to cut the picked weft yarn to separate the picked weft yarn from the weft inserting nozzle 18 and the formed selvage.

Tack-in system !2 comprises two tack-in devices 21A and 21B, which are disposed respectively outside and near the side edges of woven fabric 17. Each tack-in device 21A and 21B, is located between the cutter 22A, 22B and the woven fabric side edge. In this connection, reed 15 is such constructed that its reed blades are removed at the positions corresponding to the tack-in devices 21A and 21B, in order to avoid interference between these tack-in devices, and the reed blades. Tack-in devices 21A and 21B are constructed and arranged the same and symmetrical with respect to woven fabric 17, and therefore only the tack-in device 21A will be hereinafter discussed for the purpose of simplicity of illustration.

Figure 4:
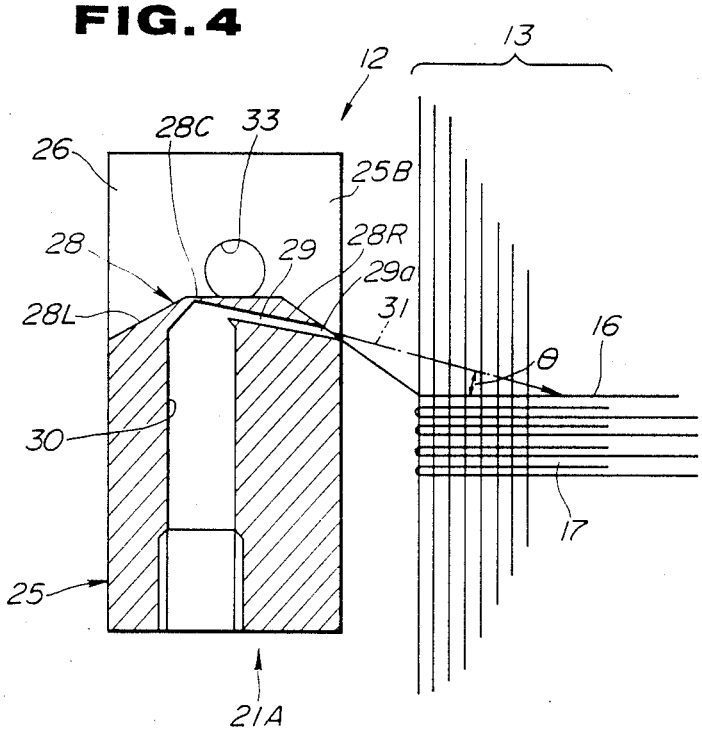
FIG. 4 is a plan view, partly in section, of an essential part of a first embodiment of a tack-in nozzle in accordance with the present invention.
Figure 5:
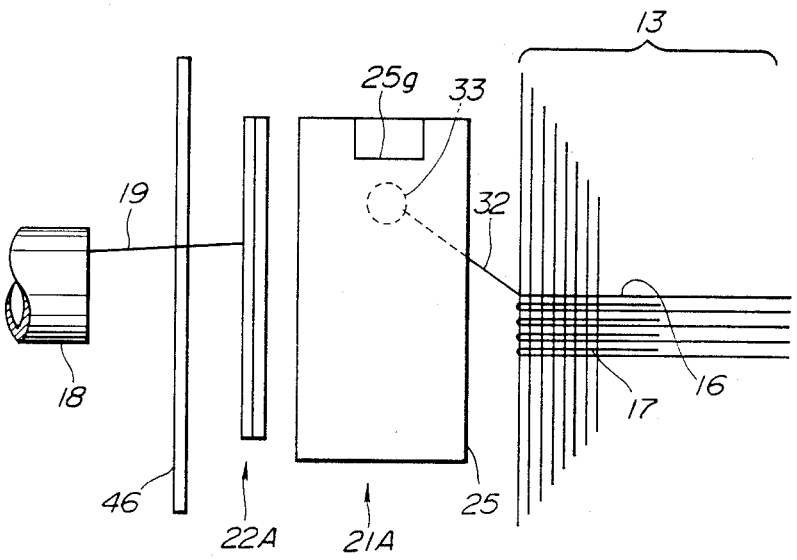
FIG. 5 is a plan view of the essential part of the tack-in nozzle of FIG. 4.
Figure 6:
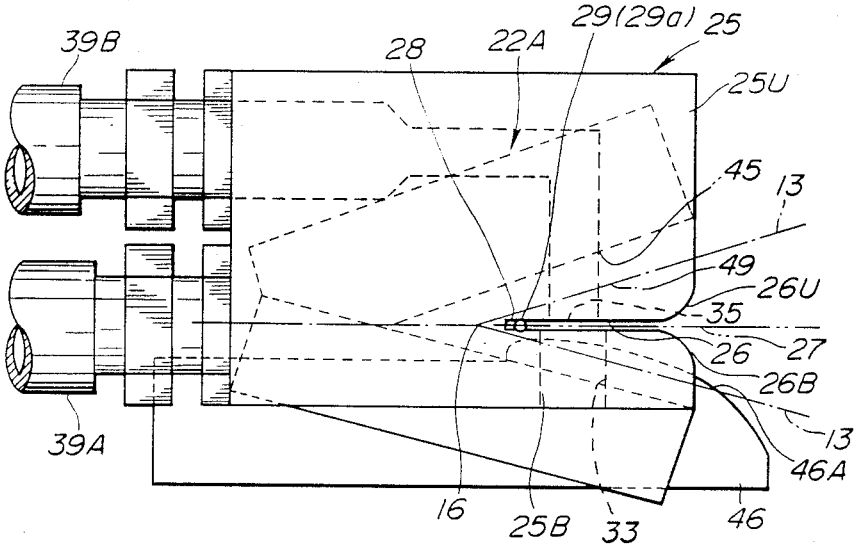
FIG. 6 is a side view of the essential part of the tack-in nozzle of FIG. 4.

As illustrated in FIGS. 4 to 7, the tack-in device 21A includes a body 25 which is formed with a slit 26 opened to the side of reed 15 and located so that a horizontal plane containing a warp line 27 (through which the warp yarn 13 extends) is positioned at the central portion of the slit 26 as shown in FIG. 6. The body 25 is mounted securely on a loom frame (not shown). Slit 26 is defined between the upper and lower sections 25U and 25B of the body 25 as shown in FIG. 6. The lower and upper edges 26U, 26B of the upper and lower sections 25U, 25B defining the front part of the slit 26 are chamfered to be rounded, so that the front part of slit 26 is gradually widened toward the side of reed 15 in order to securely guide weft yarn 19 into slit 26.

Figure 6A:
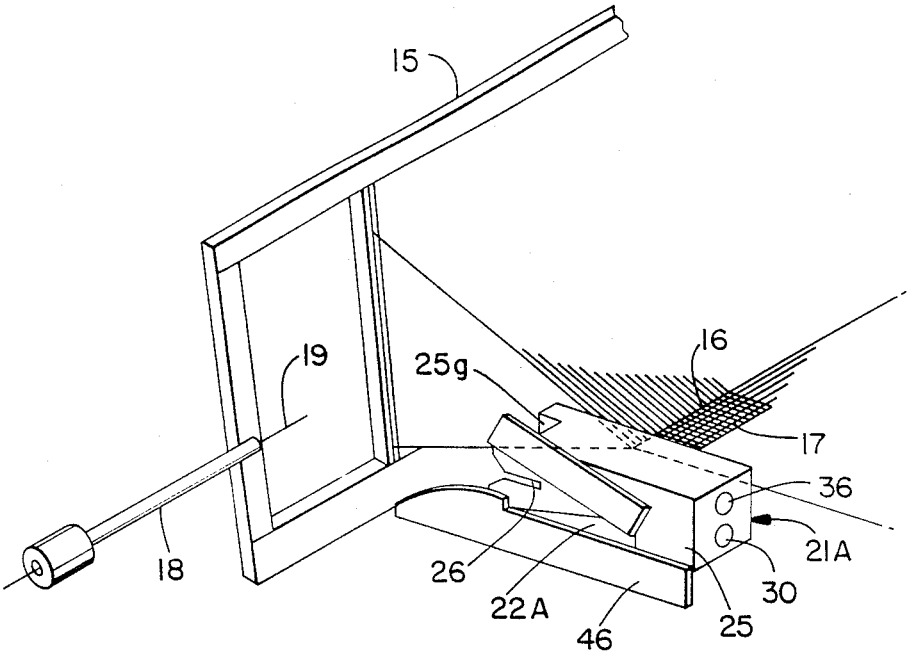
FIG. 6A is a perspective view of the essential elements of the tack-in nozzle of FIGS. 4–6.

As shown in FIG. 4, the rear end of slit 26 is defined by an innermost or end wall 28 at the rear-most portion of slit 26. The innermost wall 28 includes a central section **28*c* which laterally extends parallel with cloth fell 16 and is located forward or on the side of reed 15 relative to cloth fell 16. The right and left side sections 28R and 28L of the innermost wall 28 are integral with the central section 28*c* at the opposite ends and incline toward the side of cloth fell 6. The innermost wall right side section 28R is formed with an opening 29*a* of a tack-in nozzle 29 through which a fluid jet is ejected. An air passage 30 is formed in the body 25 and fluidly connected to the tack-in nozzle 29. As clearly illustrated in FIG. 4, the tack-in nozzle 29 is so directed that axis 31 of the fluid jet from nozzle opening 29*a* crosses cloth fell 16 at an acute angle $\theta$ on a horizontal plane (not shown) passing through cloth fell 16, i.e., as viewed from above or when projected on the horizontal plane. Accordingly, axis 31 of the fluid jet from tack-in nozzle 29 may not necessarily cross cloth fell 16 as viewed generally from a direction in which warp yarn 13 extends. The acute angle $\theta$ is preferably within a range from 2 to 6 degrees. It is also preferable that axis 31 is directed to the tip end portion 32*b* of bent end section 32 of weft yarn 19. In connection with the above, the extension of the axis of tack-in nozzle 29 preferably completely crosses cloth fell 16 at an acute angle even as viewed from the direction of extension of warp yarns 13. Slit 26 is so arranged as to locate weft yarn end section 32 at a position near the axis of tack-in nozzle 29. The upper section 25U of the body 25 is formed with a nozzle opening 35 which opens to slit 26, while the lower section 25B is formed with a receiving opening 33 which opens to slit 26 and is aligned with nozzle opening 35 to receive the fluid from nozzle opening 35. Nozzle opening 35 and the receiving opening 33 are located near the innermost wall 28 and constitute a fluid ejection type weft yarn holding device for holding the weft yarn end section 32 near the tack-in nozzle 29. As shown in FIGS. 5, 6A and 7, the upper section 25U is formed with a groove 25*g* which is located on the side of reed 15 and parallel with the nozzle opening 35 so that air around slit 26 is liable to be drawn to the stream of fluid from nozzle opening 35 to the receiving opening 33. The body 25 is formed with an air passage 36 which communicates with nozzle opening 35. A blank plug 37 is provided to form a bottom wall of the nozzle opening 35**.

Air passages 30 and 36 are fluidly connected through a regulator 40 with a pressurized air source 38. Air passage 30 is fluidly connected through a pipe line 39A with regulator 40. A electromagnetically operated valve 41 is disposed in pipe line 39A. Air passage 36 is fluidly connectable through a pipe line 39B with regulator 40. Pipe line 39B is provided with an electromagnetically operated valve 42 and a control valve 43 disposed between air passage 36 and the valve 42. Control valve 43 is adapted to control the flow of air passing through pipe line 39B. Valves 41 and 42 are constructed and arranged to open and close, thereby allowing and blocking fluid flow through pipe lines 39A, 39B, at predetermined rotational angles of a main shaft (not shown) of the loom under control of control circuit 44. The cutter 22A is disposed by the body 25 on the side of weft inserting nozzle 18 and arranged to accomplish its cutting action at a predetermined rotational angle of the loom main shaft. The cutter 22A is so located that slit 26 is within the open mouth 45 formed by the cutter blades thereof as viewed from the direction of extension of the weft yarn 19 as illustrated in FIG. 6. A plate type weft guide member 46 is disposed by the cutter 22A on the side of the weft inserting nozzle 18 and adapted such that the weft yarn 19 being beaten up is smoothly guided onto the guide surface 46A of the guide member 46 to cause the weft yarn 19 to securely enter the slit 26. The weft guide member 46 may be disposed by the right side cutter 22B, i.e., between the cutter 22B and the catch cords 20.

The manner of operation of the above-arranged tack-in system 12 will be discussed hereinafter also reference to FIGS. 5, 7 and 8.

Assume that the loom main shaft rotational angle for closing the warp shed is set at 300 degrees on the basis that the rotational angle for beating-up by reed 15 is 0 degrees. The control valve 43 is adjusted to suitably control the fluid ejection from nozzle opening 35.

Figure 10:
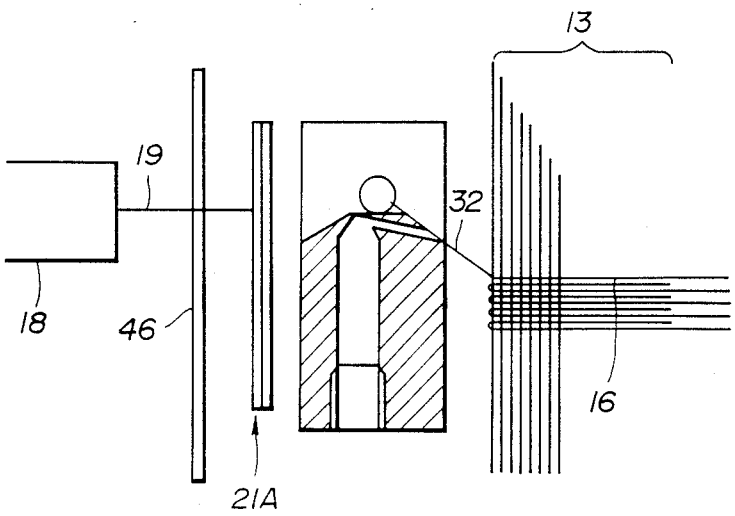
FIGS. 10 and 11 are plan views illustrating the operation of the first embodiment tack-in system of FIG. 4.

After weft picking, reed 15 advances to accomplish its beat-up motion. During this beating-up, weft yarn 19 is guided by the guide surface 46A of the weft guide member 46 and by the upper and lower edges 26U, 26B for the slit 26 and therefore advances into the slit 26. Subsequently, when the shed of the warp yarn 13 is closed and initiates to slightly open in reverse phase, the weft yarn 19 comes into contact with the central section 28C of the innermost wall 28. Then cutter 22A coming to the weft yarn 19 makes its cutting action at a loom main shaft rotational angel of 330 degrees, thus cutting the weft yarn 19 as shown in FIG. 10. At this time, valve 42 opens so that air is ejected from the nozzle opening 35 to the receiving opening 33 thereby generating an air stream. The end section 32 of the weft yarn 19 contiguous with the woven fabric 17 is drawn by the air stream. At this time, valve 41 is closed. It will be understood that since weft yarn 19 is cut when it is brought into contact with the innermost wall 28 of slit 26 to generally straighten the weft yarn 19 extending to the weft inserting nozzle 18, the length of the weft yarn end section 32 to be tacked in is minimized. Thus, the shortened weft yarn end section 32 to be tacked in is very advantageous for obtaining a good edge or selvage of the woven fabric 17.

Figure 11:
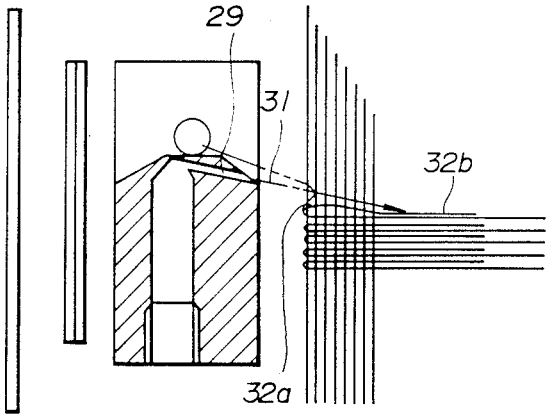

Subsequently, weft yarn 19 within the warp shed 39 is beaten up by the advancing reed 15. When reed 15 moves backward and warp shed 49 comes into a state in which weft picking is possible, the next weft picking is carried out. At a predetermined loom main shaft rotational angle of 120 degrees (as shown in FIG. 5), valve 41 is opened while valve 42 is closed. It will be understood that since valve 42 is closed while valve 41 is opened, consumption of ejected fluid is minimized thereby saving energy. Under such operation of valves 41 and 42, fluid stream from nozzle 35 gradually decreases and finally stops, and simultaneously fluid steam from tack-in nozzle 29 gradually increases to reach a predetermined flow amount of the fluid. As a result, the holding force for the weft yarn end section 32 gradually decreases, while the blowing force for the weft yarn end section 32 into warp shed 49 gradually increases. Accordingly, weft yarn end section 32 is bent at its base end portion 32*a* and formed generally in a Z-shape (as indicated by phantom lines in FIG. 11) as shown in FIG. 11. Immediately thereafter, the tip end portion 32*b* of the weft yarn end section 32 is blown into the warp yarn shed 49 as indicated by a solid line in FIG. 11. In connection with this, since axis 31 of the tack-in nozzle hole 29 crosses the cloth fell 16 at an acute angle, the air stream from the tack-in nozzle 29 is so applied as to press the tip end portion 32*b* of the weft yarn end section 32 onto the cloth fell 16, so that the tip end portion 32*b* is kept at a position close to the cloth fell 16 as compared with the base end section 32*a* of the weft yarn end section 32. The valve 41 continues until the termination of the weft picking, and thereafter is closed. Even after this valve closing, ejection of fluid from tack-in nozzle hole 29 continues for a predetermined period of time under the action of the fluid remaining within the pipe line 39A, gradually decreasing the amount of ejected fluid from the tack-in nozzle 29. Consequently, weft yarn end section 32 is restrained by the warp yarns 13 thereby maintaining the state as indicated by the solid line in FIG. 11, thus forming a tack selvage of the woven fabric 17. In this tack selvage formation process, the tension of the base end portion 32*a* of the warp yarn end section 32 is prevented from lowering below a predetermined level, and therefore the tip end portion 32*b* is prevented from being pulled to the side of the base end portion 32*a* by the warp yarns 13 near the edge of the woven fabric thereby avoiding formation of a loosened selvage. Thereafter valve 24 is opened at a loom main shaft rotational angle of 240 degrees (FIG. 5) thereby generating a fluid stream from nozzle opening 35 toward the receiving opening 33, thus standing by for the coming cutting action for weft yarn 19.

It will be understood that another tack-in device 21B functions the same as the above-discussed tack-in device 21A to form another tack selvage of the woven fabric 17. In connection with the tack-in device 21B, the warp yarn end section which is on the counter-weft picking side and cut by the cutter 22B is caught by the catch cords 20 and therefore discarded along with advance of the weaving process of the fabric 17.

Figure 12:
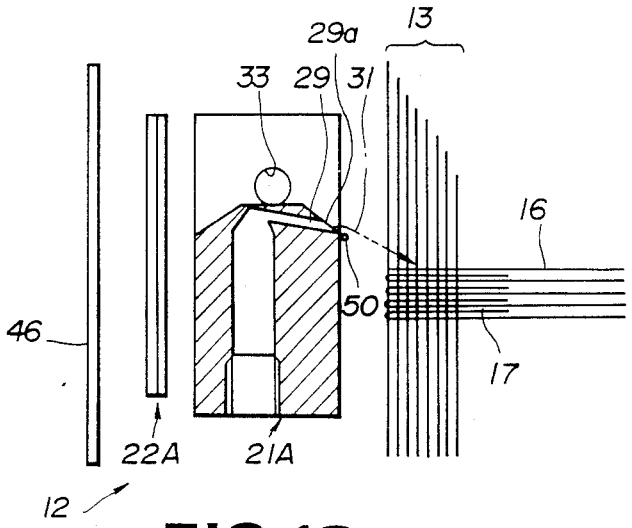
FIG. 12 is a plan view of an essential part of a second embodiment of the tack-in system in accordance with the present invention.

FIG. 12 illustrates a second embodiment of the tack-in system 12 according to the present invention, which is similar to the first embodiment with the exception that a rod 50 having a circular cross-section is disposed close to the opening 29*a* of tack-in nozzle 29 in order to adjust the direction of the fluid stream ejected from tack-in nozzle 29 under the Coanda effect due to rod 50. In this case, even if axis 31 of the air jet from tack-in nozzle opening 29*a* is parallel with cloth fell 16, axis 31 is deflected toward the side of cloth fell 16, thus crossing cloth fell 16 at an acute angle.

Figure 13:
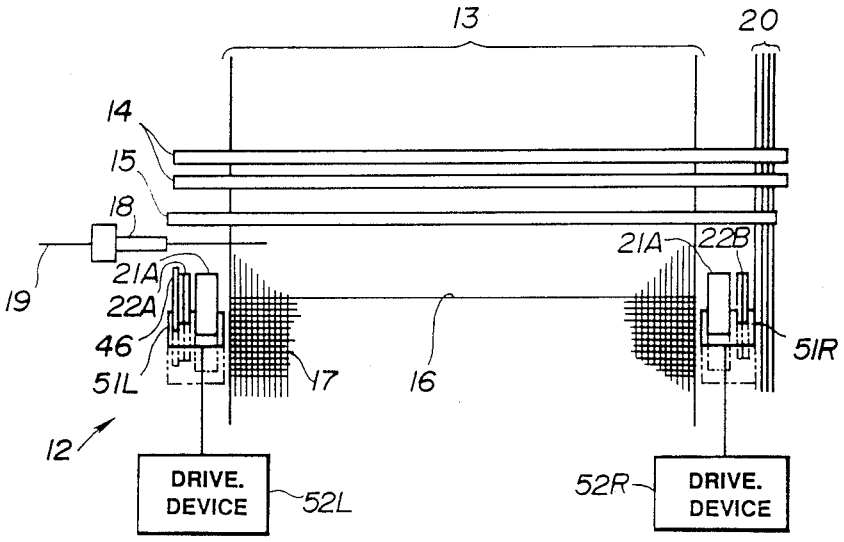
FIG. 13 is a plan view of a third embodiment of the tack-in system in combination with a shuttleless loom.

FIG. 13 illustrates a third embodiment of tack-in system 12 according to the present invention, which is similar to the first embodiment with the exception that the tack-in devices 21A, 21B, the cutters 22A, 22B and the weft guide member 46 are movable in a forward and backward direction in relation to reed 15. In this embodiment, the tack-in device 21A, the cutter 22A and the weft guide member 46 are mounted on a base member 51L, while tack-in device 21B and cutter 22B are mounted on another base member 51R. The base members 51L, 51R are respectively connected to driving devices 52L and 52R so as to be driven forward and backward along the extension direction of warp yarns 13.

With this arrangement, it is unnecessary to remove the reed blades for the purpose of avoiding interference with the tack-in devices 21A, 21B and the like, because base members 51L, 51R advance in a manner which causes them to escape from reed 15 and move backward as indicated by phantom lines in FIG. 13. Accordingly, this effectively prevents interference of reed 15 with tack-in devices 21A, 21B, cutters 22A, 22B and weft guide member 46. In a backward moving process of the reed, the base members 51L, 51R move backward (upward in FIG. 13) in a manner to follow reed 15 so as to avoid interference of reed 15 with tack-in devices 21A, 21B, the cutters 22A, 22B, and the weft guide member 46. During this process, weft yarn 19 is received into slit 26. When the central section 28C of the innermost wall 28 comes into a position close to the extension of cloth fell 16, cutter 22 makes its cutting action in timed relation to the movement of the base member 51L thereby cutting weft yarn 19. After weft yarn end section 32 of the thus cut weft yarn 19 is kept in position under the effect of the fluid ejection stream from the nozzle opening 35, tack-in device 21A further moves backward until the axis of the fluid jet from the tack-in nozzle hole 29 forms an acute angle relative to cloth fell 16 as indicated by solid lines in FIG. 13. Then during the next weft picking, weft yarn end section 32 is blown into warp shed 49, thus forming a tack-in selvage of the woven fabric 17. Thereafter, tack-in device 21A and the like are advanced to the position indicated by phantom lines in FIG. 13.

Figure 14:
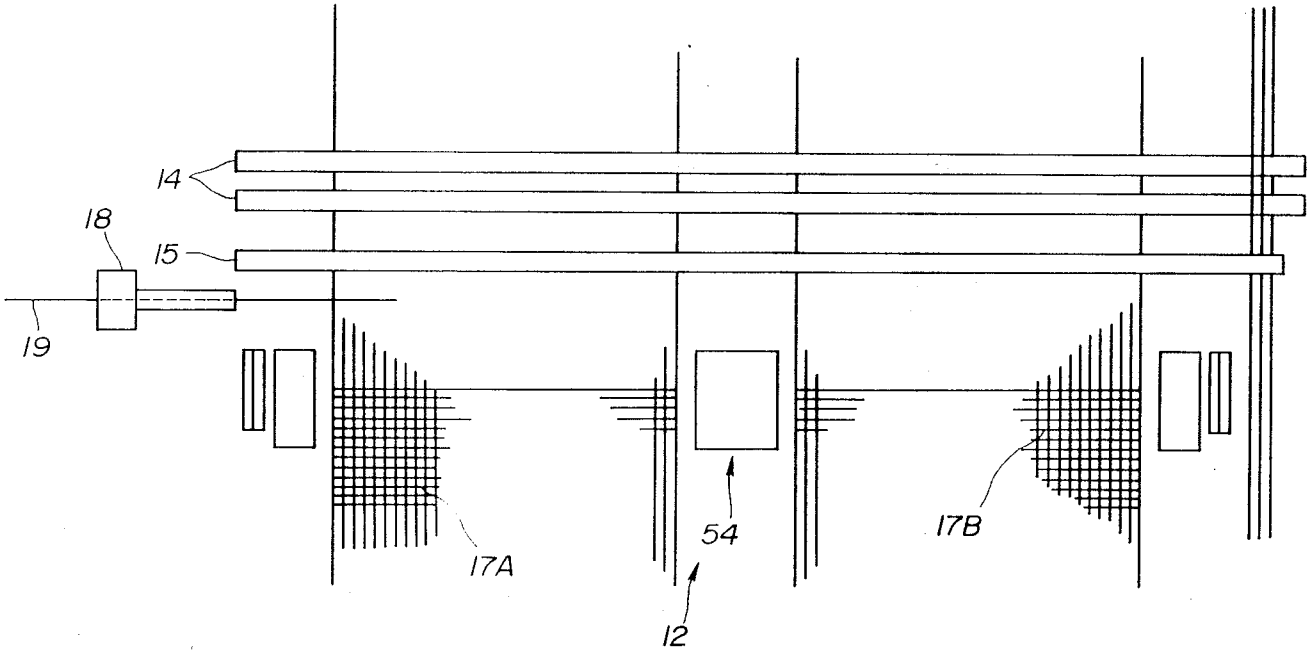
FIG. 14 is a plan view of a fourth embodiment of the tack-in system according to the present invention in combination with a shuttleless loom.
Figure 15:
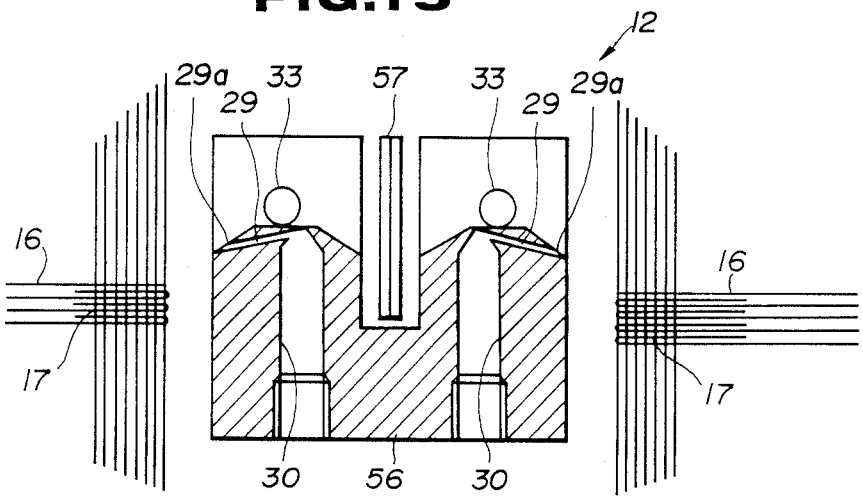
FIG. 15 is a plan view, partly in section, of an essential part of the tack-in system of FIG. 14.

FIGS. 14 and 15 illustrate a fourth embodiment of the tack-in system 12 according to the present invention which is similar to the first embodiment, in which the principle of the present invention is applied to a multiple-phase weaving loom in which a plurality of fabrics are simultaneously woven. In this embodiment, the loom is of the two-phase weaving type wherein two fabrics 17A and 17B are simultaneously woven. The loom is provided with a center tack-in device 54 disposed between the inner edges of the two woven fabrics 17A and 17B. The center tack-in device 54 includes two symmetrically located tack-in arrangements which are respectively constructed similarly to tack-in devices 21B and 21A of the first embodiment. As shown in FIG. 15, the two tack-in arrangements are securely fixed to each other to constitute a single unit. Accordingly, the center tack-in device 54 is formed with two tack-in nozzles 29 each of which has its axis cross cloth fell 16 of the woven fabric 17A and 17B at an acute angle. Additionally, a cutter 57 is provided between tack-in nozzles 29 to cut the picked weft yarns 19 for the fabrics 17A and 17B.

Figure 16:
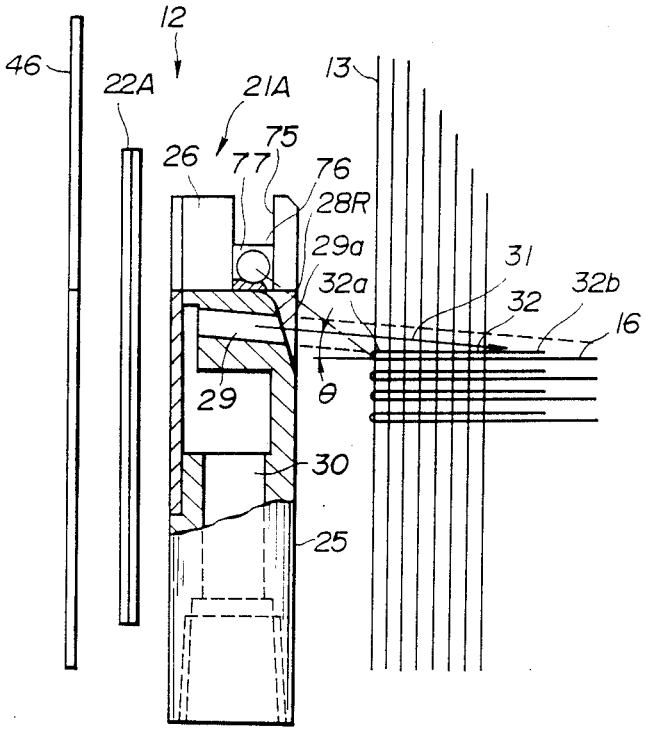
FIG. 16 is a plan view of an essential part of a fifth embodiment of the tack-in system according to the present invention.
Figure 17:
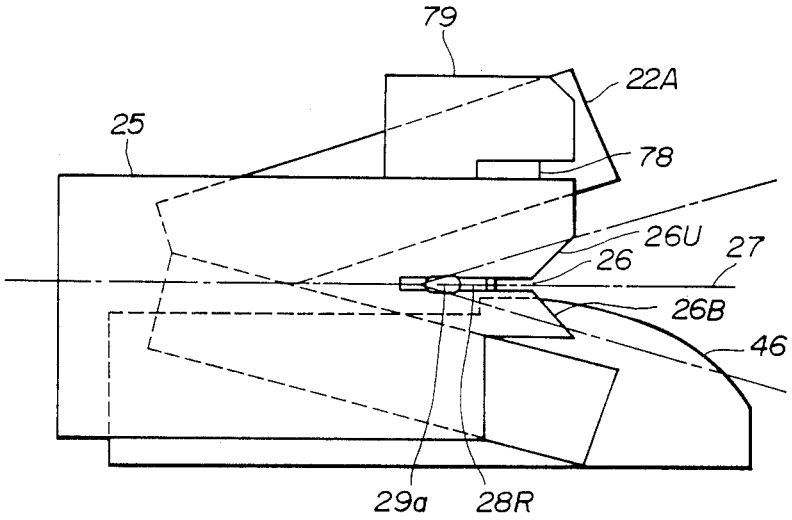
FIG. 17 is a side view of the essential part of the tack-in system of FIG. 16.
Figure 18:
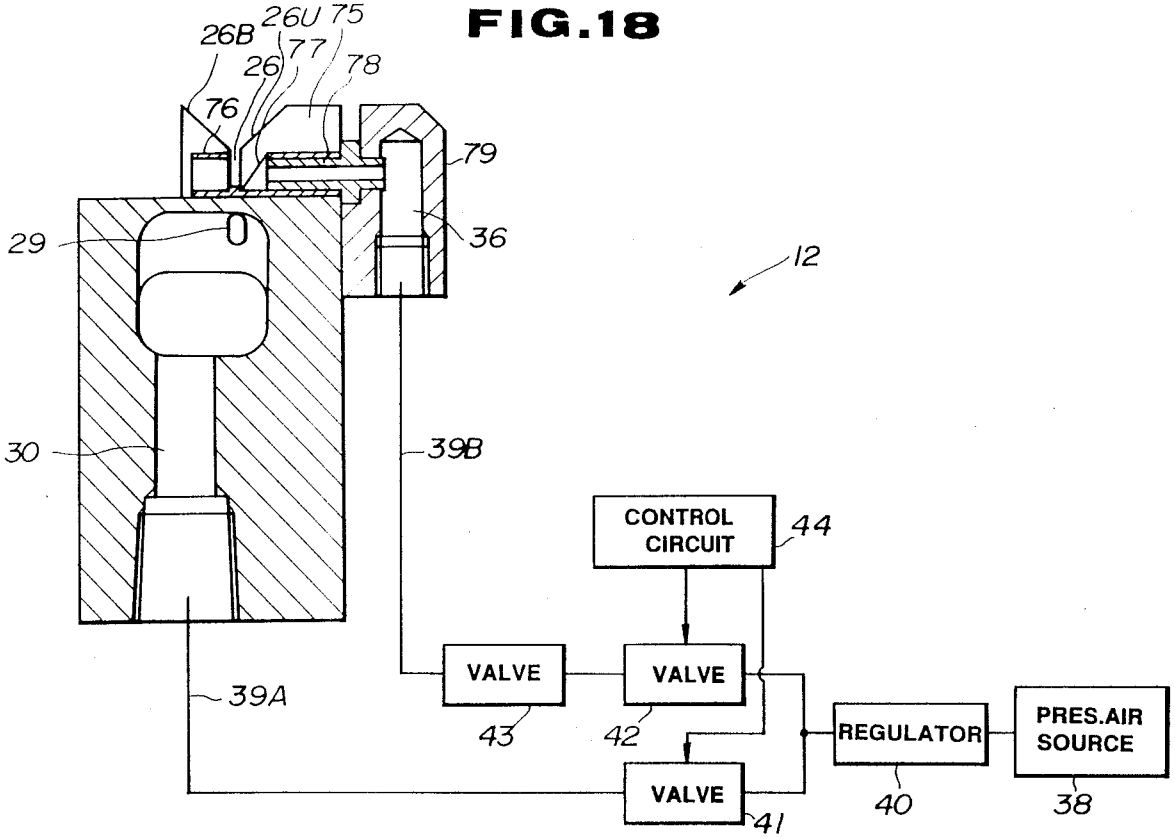
FIG. 18 is a cross-sectional view of the essential part of the tack-in system of FIG. 16, provided with a pneumatic control system.

FIGS. 16 to 18 illustrate a fifth embodiment of the tack-in system 12 according to the present invention, which is similar to the first embodiment with the exception that nozzle opening 29*a* of tack-in nozzle 29 is elongately in the direction of the warp line 27 so that the air jet ejected from tack-in nozzle 29 effectively acts on the weft yarn end section 32 throughout the base end portion 32*a* to the tip end portion 32B.

Figure 19A:
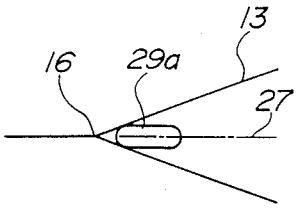
FIG. 19A is an enlarged side view of the nozzle opening of a tack-in nozzle of the fifth embodiment tack-in system of FIG. 16.

In this embodiment, the upper and lower sections 25U, 25B of the body 25 is formed respectively with cutouts 75 which reach the innermost or end wall 28 of slit 26 and are located at vertically corresponding positions. A holding pipe-like member 77 having a rectangular cross-section is fixedly fitted in the cutouts 75 and vertically extends throughout the body upper and lower sections 25U, 25B as best shown in FIG. 18. The holding pipe-like member 76 is formed with a cutout 77 at a position corresponding to slit 26 in such a manner that the inside thereof communicates with slit 26. A pipe body 78 is inserted into the pipe-like member 76 from the upper side and fixedly fitted in the pipe-like member 76 at a section within the body upper section 25U in such a manner that the ejection opening of the pipe body 78 is located slightly above the slit 26. Additionally, block 79 formed therein with the air passage 36 is fixedly mounted on the body upper section 25U in such a manner that the air passage 36 communicates with pipe body 78 thereby supplying pipe body 78 with pressurized air from the pressurized air source 38. Also in this embodiment, tack-in nozzle 29 is arranged such that the axis of the air jet ejected from nozzle opening **29*a* crosses cloth fell 16 at an acute angle $\theta$. The enlarged view of the nozzle opening 29*a* is shown in FIG. 19A, in which nozzle opening 29*a* is formed longer in the direction of the warp line 29*a***.

With this arrangement, since nozzle opening **29*a* of tack-in nozzle 29 is formed wider in the direction of warp line 27, the air jet from tack-in nozzle 29 is applied in whole to the end section 32 of the picked weft yarn 19 during air jet ejection from tack-in nozzle 29, thereby raising the traction force for the weft yarn end section 32. This accomplishes the secure bending action for weft yarn end section 32**, thus forming a rigid tack selvage.

Figure 19B:
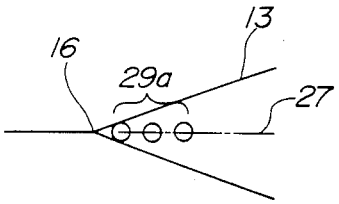
FIG. 19B is an enlarged side view similar to FIG. 19A but showing another example of the tack-in nozzle opening.
Figure 19C:
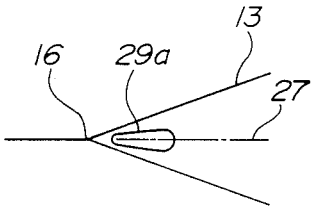
FIG. 19C is an enlarged side view similar to FIG. 19A but showing a further example of the tack-in nozzle opening.
Figure 19D:
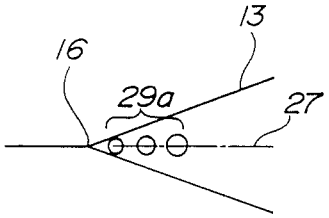
FIG. 19D is an enlarged side view similar to FIG. 19A but showing a further example of the tack-in nozzle opening.

FIGS. 19B, 19C and 19D show a variety of modified examples of nozzle opening **29*a* of the tack-in nozzle 29. The nozzle opening 29*a* shown in FIG. 19B includes a plurality of small circular openings which are aligned along warp line 27. The nozzle opening 29*a* shown in FIG. 19C is formed such that the vertical width thereof changes along warp line 27. The nozzle opening 29*a* shown in FIG. 19D includes a plurality of circular openings having different diameters which openings are aligned along warp line 27**.

Figure 20:
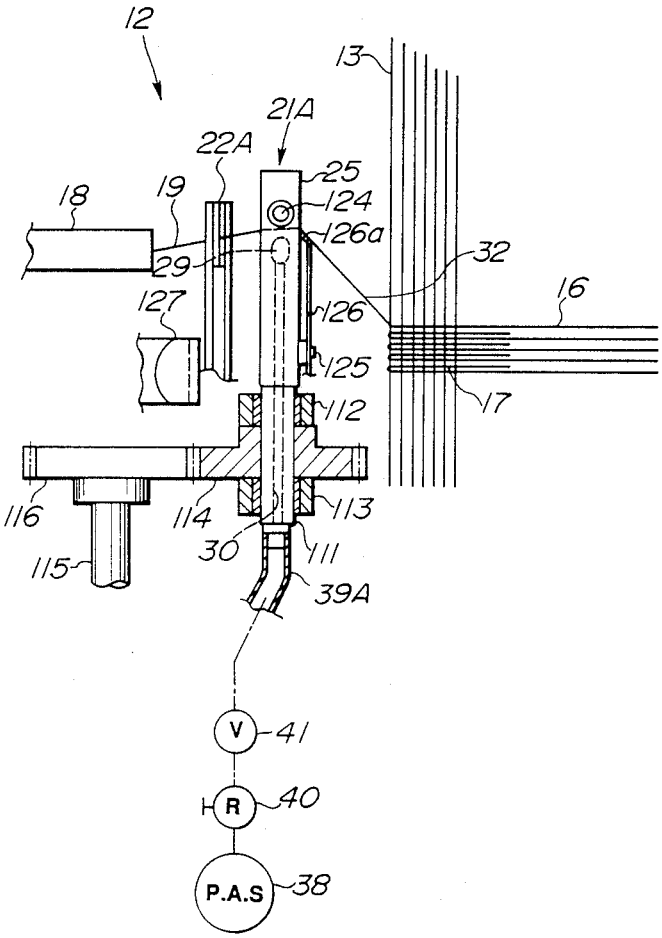
FIG. 20 is a plan view, partly in section, of an essential part of a sixth embodiment of the tack-in system according to the present invention.
Figure 21:
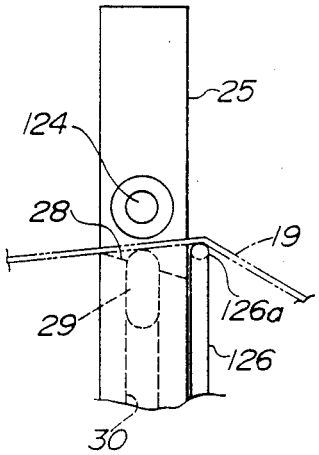
FIG. 21 is an enlarged plan view of a part of the tack-in system of FIG. 20 at a time immediately preceding the cutting of a weft yarn.
Figure 22:
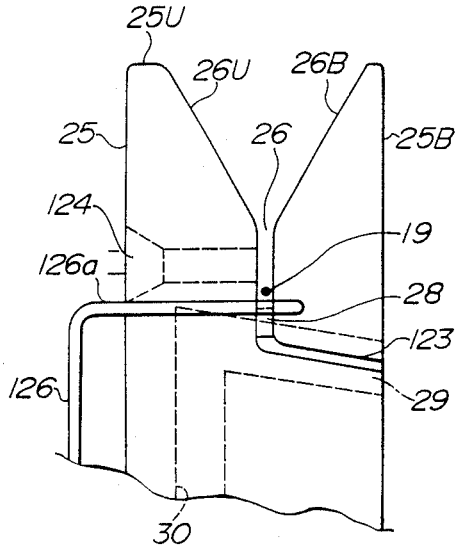
FIG. 22 is a side view of the part of FIG. 21.
Figure 23:
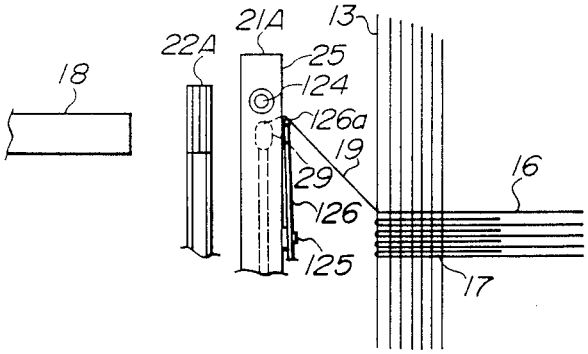
FIG. 23 is a plan view showing the state of the tack-in system of FIG. 20 at the time immediately preceding the cutting of a weft yarn.
Figure 24:
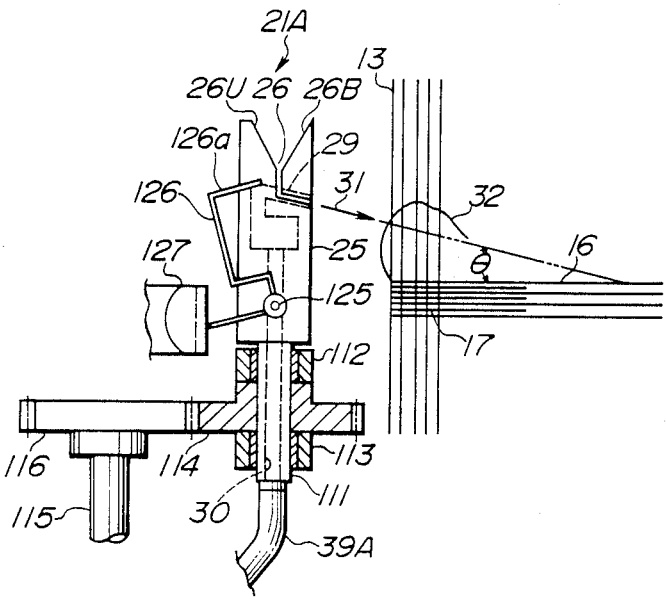
FIG. 24 is a plan view illustrating the state of the tack-in system of FIG. 20 at the timing of blowing a weft yarn end section.

FIGS. 20 to 24 illustrate a sixth embodiment of tack-in system 12 in accordance with the present invention similar to the first embodiment except for the fact that body 25 of tack-in device 21A is supported rotatably around its longitudinal axis. In this embodiment, the body 25 of the tack-in device 21A is formed elongated along the extension of the warp yarns 13 and has a shaft section 111 which is rotatably journalled within bearings 112, 113. An annular gear 114 is securely mounted on shaft 111 and in mesh with circular gear 116 which is securely mounted on drive shaft 115. The drive shaft 115 makes its reciprocating angular motion timed in relation to the rotation of the loom main shaft. Accordingly, drive shaft 115 causes the tack-in device body 25 to rotate around its axis through the gears 116, 114. As a result, the body 25 takes a first position as shown in FIG. 20 and a second position as shown in FIG. 24 in which the body 25 rotates by about an angle of 90 degrees from the position of FIG. 20. Accordingly, tack-in nozzle 29 is directed to the side of the shed of the warp yarns 13 when the tack-in device body 25 takes its second position as shown in FIG. 24.

In this embodiment, the innermost or end wall 28 inclines toward the side of cloth fell 16. As shown in FIG. 24, the body 25 is formed with a cutout 123 which extends along the side wall of tack-in nozzle 29 and is in communication with the inside of nozzle 29. Additionally, the body 25 is formed with an air suction hole 124 which extends from the upper surface and reaches slit 26. The body 25 is provided at its side surface in the position of FIG. 20 with a pivot shaft 125 on which an engagement pin 126 is pivotally mounted. The engagement pin 126 is adapted to move along the side surface of the body 25 and take such a position that its engagement section **126*a* is located slightly on the side of the reed (not shown) relative to the innermost or end wall 28 of slit 26 in its first position shown in FIG. 20 by virtue of a rotational moment due to the weight of engagement pin 126. In the position shown in FIG. 24, an end section of the engagement pin 126 opposite to the engagement section 126*a*, is adapted to be brought into contact with a cam 127, so that the engagement section 126*a* is withdrawn from the side of the slit 26 as shown in FIG. 24**.

Figure 25:
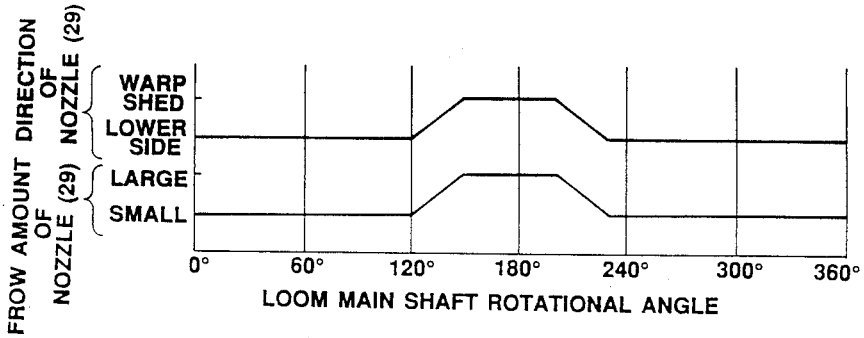
FIG. 25 is a timing chart showing the state of the tack-in nozzle of the tack-in system of FIG. 20.

In operation with reference to FIG. 25, after completion of weft picking by the weft inserting nozzle 18, beating-up operation is carried out upon advancing the reed. During this beating-up process, the weft yarn 19 advances into the opening of cutter 22A and into slit 26 under the guiding action of the upper and lower rounded edges 26U, 26B of slit 26. Then, after closing of the warp shed at a loom main shaft rotational angle of 300 degrees, weft yarn 19 is brought into contact with the end wall 28 of slit 26 and with the engagement pin engagement section **126*a* when the shed of warp yarns 13 initiate to slightly open in reverse phase. Thereafter, weft yarn 19 within the warp shed is beaten up against cloth fell 16 upon a further advance of the reed. At a timing in the vicinity of this beating-up operation, cutter 22A makes its cutting action thereby cutting weft yarn 19 during a process from the state of FIG. 20 to the state of FIG. 23. At this time, the flow control valve 41 is in a half-opened state a relatively low flow of that air jet is generated from tack-in nozzle 29. Under the action of this air jet, air is sucked from the front widened part of slit 26 and the air suction hole 124, so that the end section 32 of cut weft yarn 19 is drawn under the action of air stream. Accordingly, the weft yarn end section 32 is sucked into tack-in nozzle 29 to be kept in a tensioned state after being engaged with or caught by the engagement section 126*a* of the engagement pin 126. It will be understood that the air suction hole 124 is provided for the purpose of compensating an insufficient amount of air sucked only through slit 26**.

Subsequently, when the opening degree of the shed of warp yarns 13 reaches a level at which weft picking is possible upon the backward movement of the reed, the next weft picking is carried out. At a predetermined loom main shaft rotational angle of 120 degrees during this weft picking process, the tack-in nozzle body 25 rotates under the rotation of drive shaft 115, so that tack-in nozzle 29 is directed to the warp shed. Then the engagement pin 126 is brought into contact with cam 127 to make its pivotal movement upon rotation of the body 25. Accordingly, the engagement pin 126 is withdrawn from the side of slit 26, thereby releasing the engagement with weft yarn 19. Simultaneously the flow control valve 41 enters its fully opened state. This increases the amount of air jet flow from tack-in nozzle 29 which increases the traction force of the air jet. At this time, the weft yarn end section 32 is carried through cutout 123 under the action of the air jet of tack-in nozzle 29 and blown into the shed of warp yarns 13. The axis 31 of the first jet from tack-in nozzle 29 crosses cloth fell 16 at an acute angle $\theta$ as shown in FIG. 24. Thereafter, the weft yarn end section 32 is restrained together with the next picked weft yarn by warp yarns 13, maintaining a state as being blown into the warp shed. This forms a tack selvage of fabric 17.

At a predetermined loom main shaft rotational angle of 200 degrees, flow control valve 41 enters its half-opened state. Then the body 25 rotates under rotation of drive shaft 115 so that tack-in nozzle 29 is directed downward, while the engagement pin 126 is separated from cam 127 to be restored to its original position, thus standing ready for the following weft cutting. It will be understood engagement pin 126 may be omitted, but preferable to securely and effectively operate the above-discussed tack-in system 12.

Figure 26:
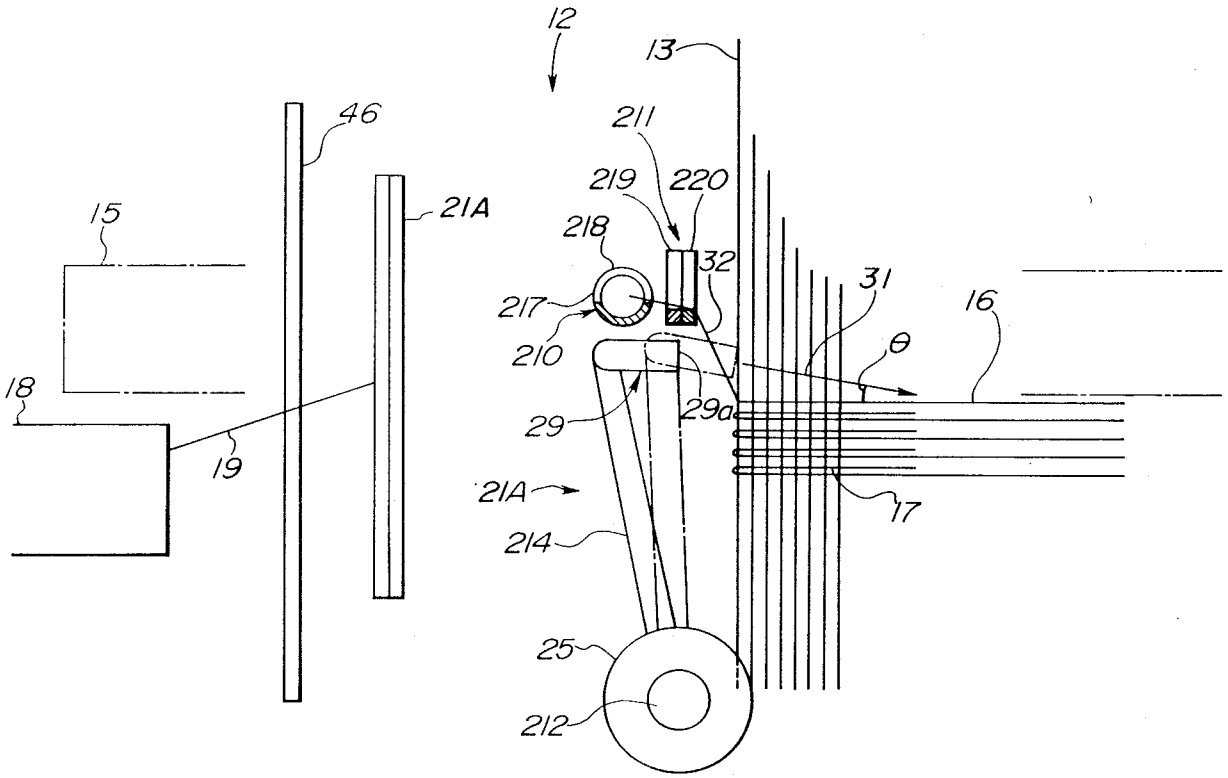
FIG. 26 is a schematic plan view of an essential part of a seventh embodiment of the tack-in system according to the present invention.
Figure 28:
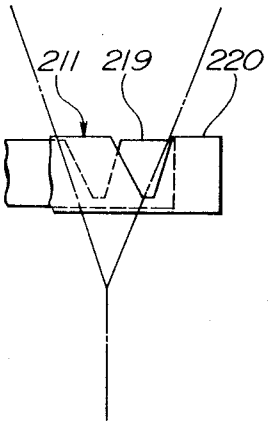
FIG. 28 is a side view of a cutter used in the tack-in system of FIG. 26.
Figure 27:
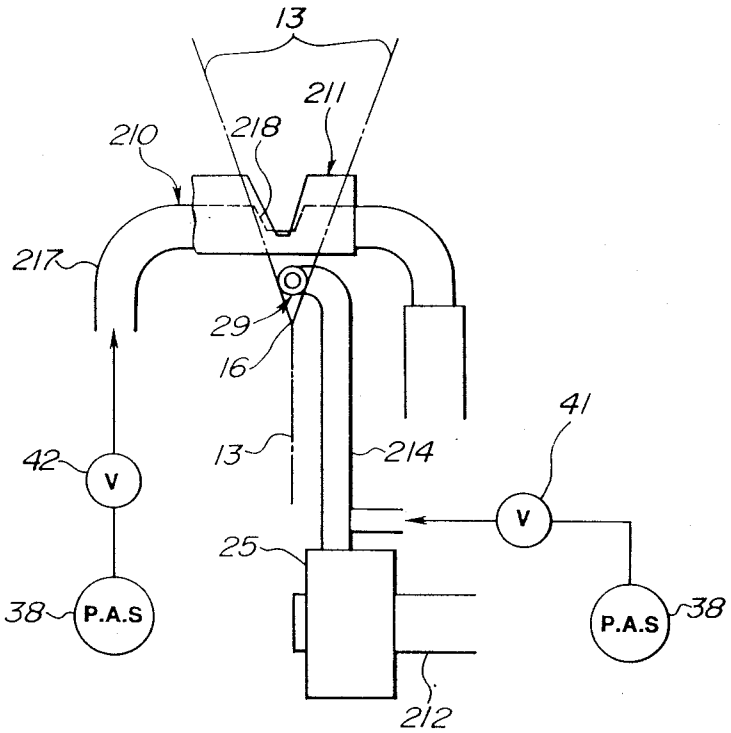
FIG. 27 is a side view of an essential part of the tack-in system of FIG. 26.

FIGS. 26 to 28 illustrate a seventh embodiment of tack-in system 12 in accordance with the present invention, which is similar to the first embodiment except for the addition of an arrangement of reducing the width of the tack selvage formed at the edge section of the woven fabric. In this embodiment, the tack-in device 21A includes tack-in nozzle 29. A weft holding device 210 of the air stream type is provided near tack-in nozzle 29. A tack length shortening cutter 211 is provided near the weft holding device 210. Weft guide member 46 is located and shaped as to securely guide weft yarn 19 projected from weft inserting nozzle 18 along its guide surface and thus allows it to enter the open mouth 218 of the weft holding device 210 and the opened section of the tack length shortening cutter 211.

Tack-in nozzle 29 forms part of a pipe 214 and is formed by bending an end section of a pipe 214 in such a manner that the axis of nozzle 29 is directed to the shed of warp yarns 13. The axis of nozzle 29 is located rearward of the extension of cloth fell 16 and on a horizontal plane containing warp line 27. The pipe 214 is securely fixed to the body 25 which is pivotally mounted on a support shaft 212, so that nozzle 29 takes a first position (indicated by solid lines in FIG. 26) relatively separate from the array of the warp yarns 13, and a second position (indicated by phantom lines in FIG. 26) relatively close to the warp yarn array. Nozzle 29 is adapted such that axis 31 of the air jet ejected from the nozzle 29 crosses cloth fell 16 at an acute angle $\theta$ when located at the second position indicated by phantom lines in FIG. 26.

The weft holding device 210 includes a part 217*a* of a pipe 217 which is connected through valve 42 with pressurized air source 38. The pipe part 217*a* is located slightly rearward of tack-in nozzle 29 and extends vertically. The pipe part 217*a* is formed with a cutout opening 218 which is located on the side of reed 15 and at the central portion thereof in the longitudinal direction. Accordingly, the air jet passes through the cutout opening 218 to generate a traction air stream at the cutout opening 218 directed downward.

The tack length shortening cutter 211 is located between the weft holding device 210 and the edge of the woven fabric 17, more specifically between the weft holding device 210 and nozzle opening 29*a* of tack-in nozzle 29 at the second position shown by phantom lines in FIG. 26. As shown in FIG. 3, the cutter 211 includes a fixed blade member 219 and a movable blade member 220 each of which is formed with a cutting blade section. The movable blade member 220 is vertically movable relative to the fixed blade member 219 thereby cutting the weft yarn 19 put between the blade sections of the blade members 219, 220. Thus, weft yarn 19 extending from the edge of the warp yarn array to the warp holding device 210 is cut at a predetermined loom main shaft rotational angle.

Figure 29:
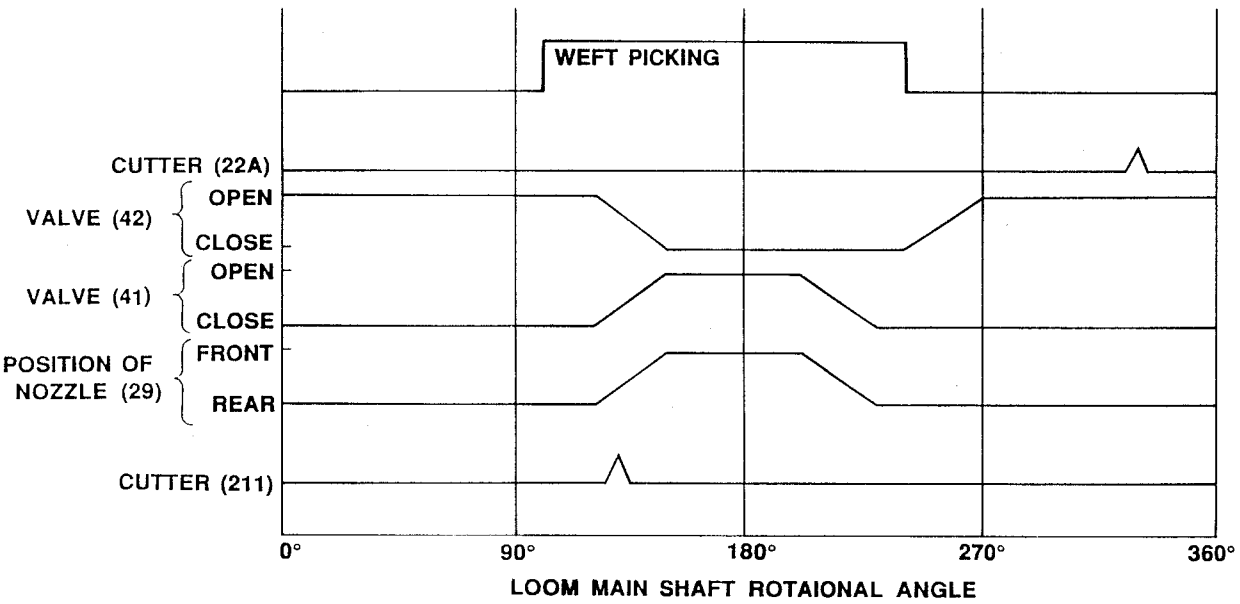
FIG. 29 is a timing chart showing the operation of cutters and valves for a pneumatic control of the tack-in system of FIG. 26.

In operation with reference to FIG. 29, after weft picking by the weft inserting nozzle 18, beating-up for the picked weft yarn 19 is carried out upon advancing reed 15. During this beating-up process, weft yarn 19 is guided along the upper edge of the weft guide member 46 and advances into the opening of the cutter 21A, the cutout opening 218 of the weft holding device 210 and the open blade sections of the tack length shortening cutter 211 when the warp shed initiates to slightly open in reverse phase after the closing of the warp shed at a loom main shaft rotational angle of 300 degrees. Immediately after this, the cutter 21A makes its cutting action at a loom main shaft rotational angle of 330 degrees thereby cutting weft yarn 19. At this time, valve 42 is closed and therefore generating a traction air stream at the cutout opening 218 of the weft holding device 210 from the air jet passing through the pipe 217. Consequently, the end section 32 of the picked and cut weft yarn connected to the woven fabric 17 is drawn through the cutout opening 218 into the lower portion of the part 217*a* of the pipe 217, thereby being kept in a tensioned state as shown in FIG. 26. At this time, valve 41 is closed. Subsequently, weft yarn 19 within the warp shed is beaten up against the cloth fell. When the opening degree of the warp shed reaches a level at which weft picking is possible upon backward movement of reed 15, the next weft picking is carried out.

At a predetermined loom main shaft rotational angle of 120 degrees during this weft picking, valve 42 is closed while valve 41 is opened. Accordingly, the air stream for traction in the weft holding device 210 gradually reduces and is finally stopped, while the air jet ejected from tack-in nozzle 29 is gradually strengthened to a predetermined flow level. As a result, the traction force for the weft yarn end section 23 gradually decreases in the weft holding device 210, while force for drawing the weft yarn end section 32 into the warp shed gradually increases.

During this process, the tack length shortening cutter 211 is operated to cut the weft yarn end section 23 at a position between the warp holding device 210 and the edge of the woven fabric 17, more specifically between the warp holding device 210 and the nozzle opening 29*a* of tack-in nozzle 29. This shortens the length of the weft yarn end section 32 projected from the edge of the woven fabric 17, thereby reducing the length of the weft yarn end section 32 to be tacked. Thereafter, the weft yarn end section 32 is bent back and blown into the shed of the warp yarns 13 by the air jet ejection from tack-in nozzle 29. The end portion of the weft yarn end section 32 which is cut free, is sucked into the pipe 217*a* of the weft holding device 210 to be discarded.

During this air ejection from tack-in nozzle 29, the body 25 rotates around the support 212 and therefore the pipe 214 rotates clockwise in FIG. 26 so that tack-in nozzle 29 comes close to the shed of the warp yarns 13. This accomplishes secure blowing-in operation of the weft yarn end section 32 into the shed. Valve 41 is kept opened until the vicinity of completion of the weft picking, and thereafter closed at a predetermined loom main shaft rotational angle of 200 degrees. Even after this closing of valve 41, air ejection from tack-in nozzle 29 is maintained for a predetermined time through the amount of air flow gradually decreases. Accordingly, the weft yarn end section 32 is restrained together with a next picked and beaten up weft yarn by the warp yarns, maintaining its state as blown in. This forms a tack selvage at the edge section of the woven fabric 17. Valve 42 is opened at a loom main shaft rotational angle of 240 degrees immediately after the completion of the weft picking, thereby generating traction air stream in the weft holding device 210 thus standing ready for the next weft yarn cutting.

Figure 30:
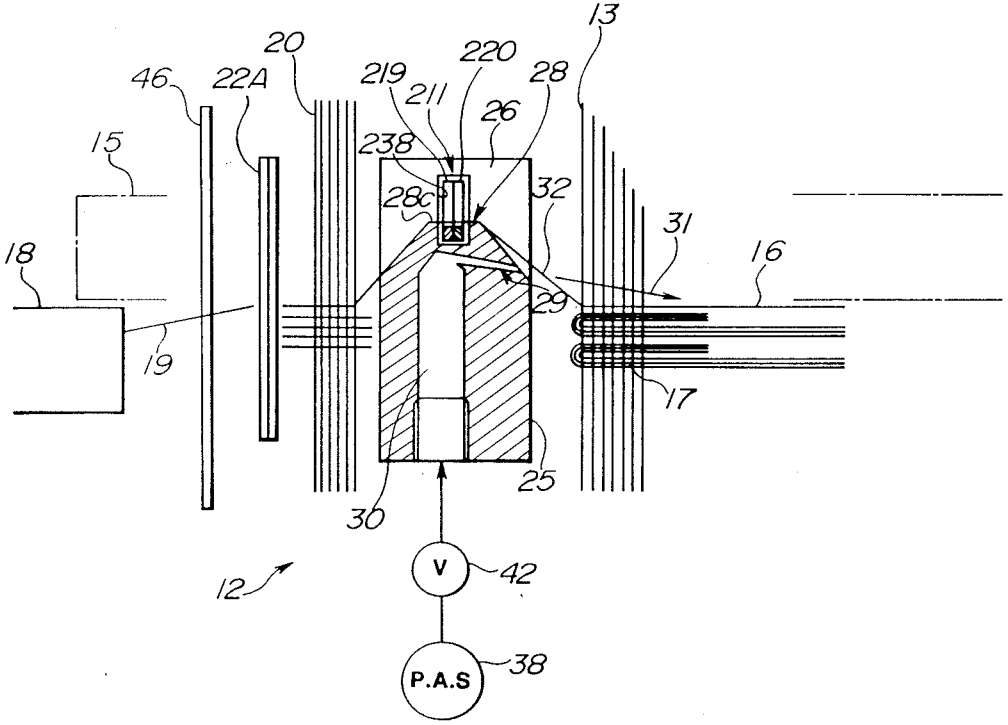
FIG. 30 is a plan view, partly in section, of an eighth embodiment of the tack-in system according to the present invention.
Figure 31:
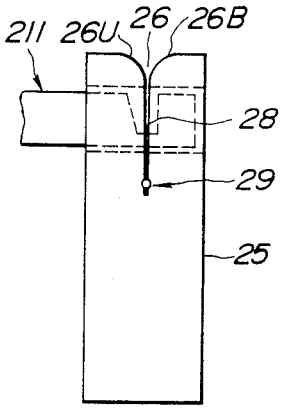
FIG. 31 is a side view of an essential part of the tack-in system of FIG. 30.
Figure 32:
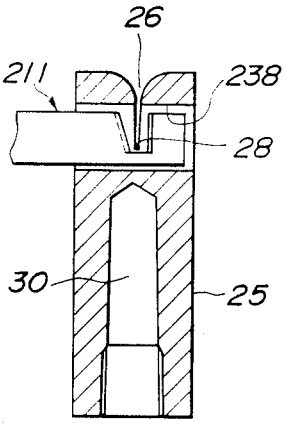
FIG. 32 is a sectional view of the essential part of FIG. 31.

FIGS. 30 to 32 illustrate an eighth embodiment of the tack-in system 12 in accordance with the present invention, similar to the seventh embodiment of FIGS. 26 to 28, in which the body 25 of the tack-in device 21A is similar to that of the first embodiment of FIG. 1. The shuttleless loom equipped with tack-in system 12 of this embodiment is adapted to weave a pile fabric represented by a towel. For the purpose of weaving the pile fabric, the end sections of plural (for example, three) weft yarns are simultaneously tacked in, therefore providing a plurality of catch cords 20 for holding the plural weft yarns. The catch cords 20 are located between the tack-in device body 25 and the cutter 21A and adapted to carry out opening and closing actions alternately similarly to the warp yarns 13.

In this embodiment, the tack length shortening cutter 211 is movably disposed within a vertically extending hole 238 having a rectangular cross-section which hole is formed in the tack-in device body 25. The hole 238 is located to merge with slit 26. The hole 238 extends in the direction of extension of the warp yarns 13 over the central section **28*c* of the innermost or end wall 28 of slit 26. Accordingly, the tack length shortening cutter 211 is adapted to cut the end section 2 of weft yarn 19 passed on the end wall 28 of slit 26 and located between the catch cords 20 and the edge of the woven fabric 17**.

In operation, after the completion of the weft picking by the weft inserting nozzle 18, weft yarn 19 is beaten up upon advancing of reed 15. During this beating-up process, weft yarn 19 is guided along the upper edge of the weft guide member 46 and under the guiding action of upper and lower rounded edges 26U, 26B thus advancing into the opening of the cutter 21A and the slit 26. After the closing of the warp shed, weft yarn 19 is brought into contact with or comes close to the innermost or end wall 28 when the shed of the warp yarns 13 initiates to slightly open in reverse phase. At this time, the catch cords 20 also close their shed-like openings thereby securely catching weft yarn 19. Thereafter, the cutter 21A makes its cutting action to cut weft yarn 19 as shown in FIG. 30.

Consequently, the weft yarn 19 within the shed or the warp yarns 13 is beaten up against the cloth fell 16. Next, when the opening degree of the warp shed reaches a level at which weft picking is possible upon backward movement of reed 15, the next weft picking is carried out. After the three weft yarns 19 are thus successively picked and beaten up, valve 42 is opened during the weft picking of the next first weft yarn. Accordingly, the flow amount of air jet from tack-in nozzle 29 gradually increases to a predetermined level, thereby gradually increasing force for blowing the weft yarn end section 2 into the shed of the warp yarns 13. During this process, the tack length shortening cutter 211 operates thereby to cut the three weft yarn end sections 32 passed on the end wall 28 of slit 26 and located between the catch cords 20 and the edge of the woven fabric 17, more specifically at the central section of the end wall 28.

By the above operation, the weft yarn end sections 32 projected from the edge of the woven fabric 17 are shortened. Thereafter the three weft yarn end sections 32 are bent back and blown in the warp shed under the air jet ejected from tack-in nozzle 29. A part of weft yarn 19 separated upon being cut by the cutter 21A and 211 is securely caught by the catch cords 20 and discarded as in the state being caught by the catch cords. Valve 42 is kept opened until the termination of the weft picking and thereafter closed. Even after this valve closing, tack-in nozzle 29 continues to eject an air jet for a predetermined time under the action of residual air within the air passage 30, gradually decreasing the amount of flow of the air jet. Accordingly, the three weft yarn end sections 32 bent back and blown in the warp shed are restrained together with the next picked first weft yarn by the warp yarn 13, maintaining the state as they are. Thus, a tack selvage is formed at the edge section of the woven fabric 17.

Figure 33:
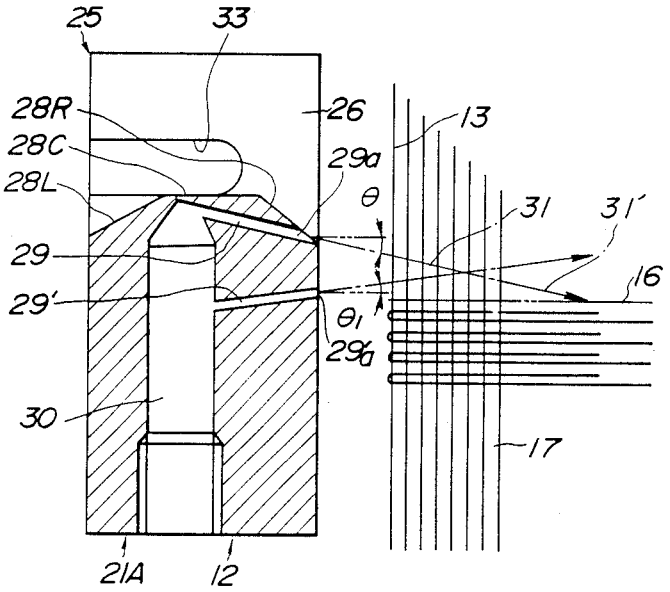
FIG. 33 is a plan view, partly in section, of an essential part of a ninth embodiment of the tack-in system in accordance with the present invention.
Figure 34:
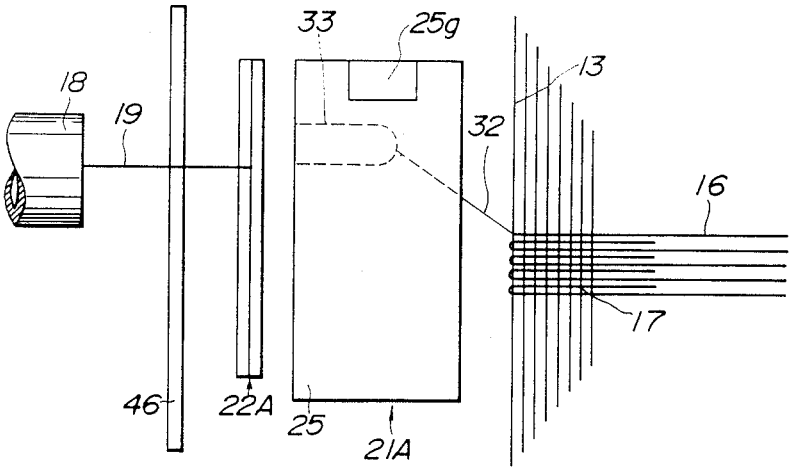
FIG. 34 is a plan view of an essential part of the tack-in system of FIG. 33.
Figure 35:
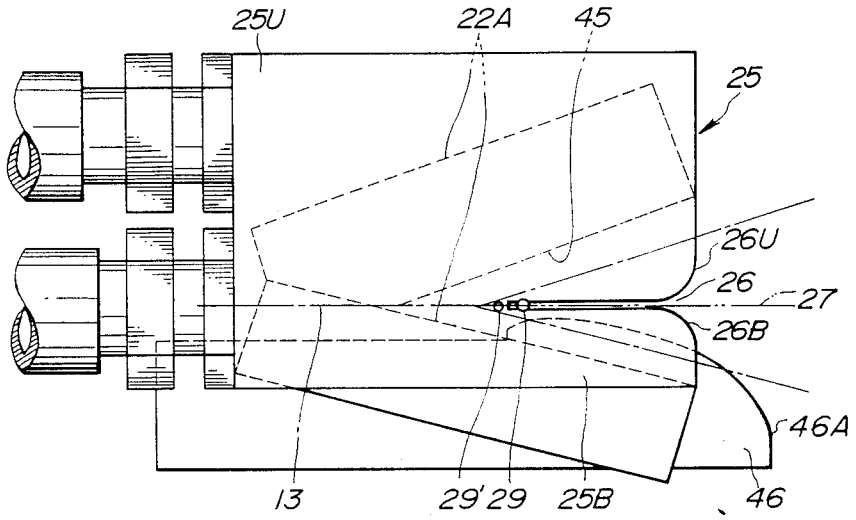
FIG. 35 is a side view of the essential part of FIG. 33.
Figure 36:
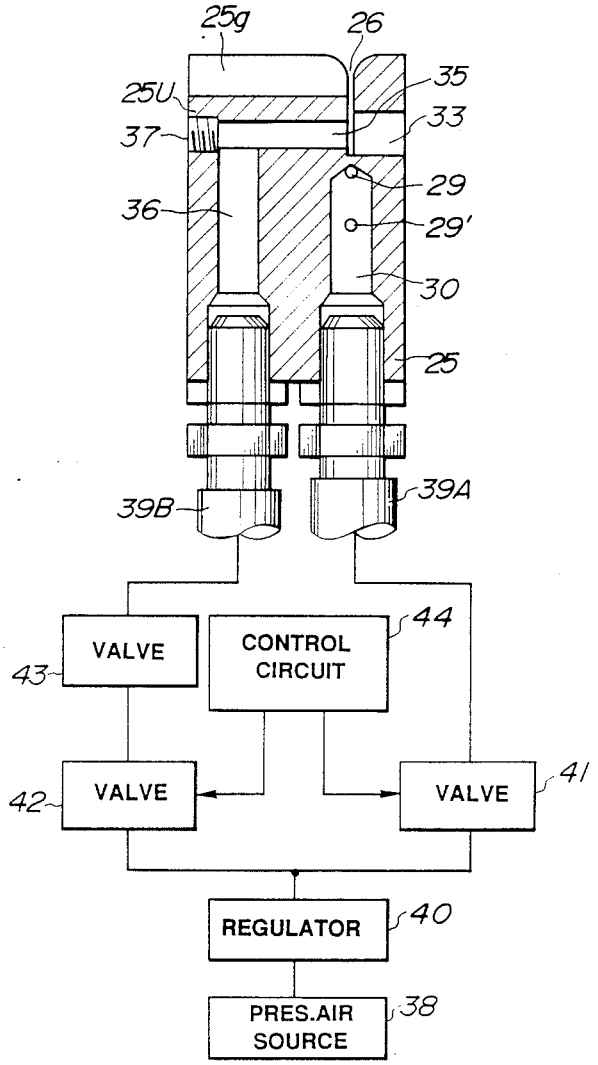
FIG. 36 is a sectional view of the essential part of FIG. 33 provided with a pneumatic control system.

FIGS. 33 to 36 illustrate a ninth embodiment of the tack-in system 12 in accordance with the present invention, which is similar to the first embodiment of FIGS. 1 to 7 with the exception that another or auxiliary tack-in nozzle 29' is formed in the tack-in nozzle body 25 in addition to the tack-in nozzle 29. In this embodiment, tack-in nozzle 29 is so directed that the axis 31' of air jet ejected from nozzle opening **29*a* crosses the cloth fell 16 at an acute angle $\theta$ as viewed from the above or as shown in FIG. 33, similarly to in the first embodiment. Another tack-in nozzle 29' is formed near tack-in nozzle 29 and has a nozzle opening 29*a'* from which the air jet is ejected which nozzle opening is formed at the side surface of the body 25 and located near and on the far side from reed 15 relative to nozzle opening 29*a* of tack-in nozzle 29. Tack-in nozzle 29' is so directed that the axis 31' of the air jet ejected from nozzle opening 29*a'* crosses the axis 31 and forms an acute angle $\theta_1$ relative to the cloth fell 16 as viewed in plan or as shown in FIG. 33. The acute angle $\theta$ is preferably within range from 2 to 6 degrees, while the acute angle $\theta_1$ is preferably within a range from 0 to a value of $2\times\theta_1$. Assuming that the cross-sectional area (or diameter) of the nozzle opening 29*a* of tack-in nozzle 29 is E while that of the nozzle opening 29*a'* of the another tack-in nozzle 29' is F, it is preferable that E is larger than F. Additionally in this embodiment, the air receiving opening 33 is elongated in the direction far from the edge of the array of the warp yarns 13 and reaches the side surface of the body 25** opposite to the side surface close to the warp yarn array.

Figure 37:
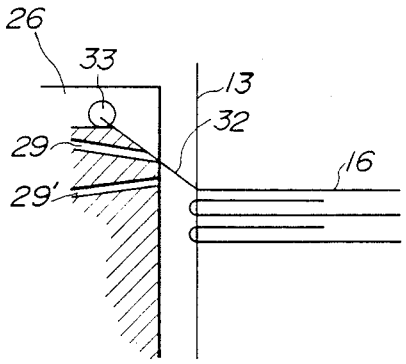
FIGS. 37 to 40 are schematic illustrations showing the operation of the tack-in system of FIG. 33.

With reference to FIGS. 37 to 40, after the weft yarn 19 is cut by the cutter 22A, the weft yarn end section 32 contiguous with the cloth fell 16 is drawn by the air stream passing through the receiving opening 33 and therefore is held in the receiving opening 33 as shown in FIG. 37, thus holding the weft yarn end section 32 in a tensioned state prior to a tack-in operation.

Figure 38:
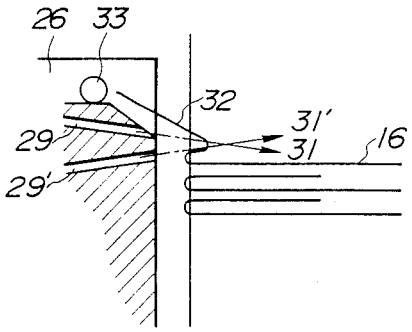
Figure 39:
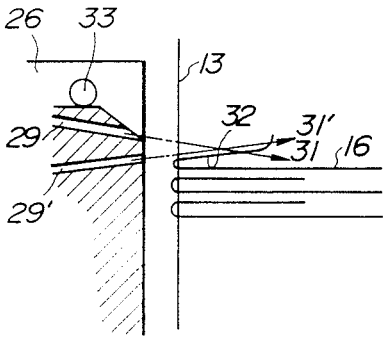

Subsequently, as shown in FIG. 38, when the opening degree of the shed of the warp yarns 13 reaches a level at which weft picking is possible upon a further backward movement of the reed 15, the next weft picking is carried out. As the reed 15 moves backward in FIG. 38, valve 41 is opened while valve 42 is closed. Then the air stream from nozzle opening 35 reduces in amount and finally stops, while the amount of air ejected from tack-in nozzles **29*a* and 29*a'* increases to a predetermined level. As a result, force for holding the weft yarn end 32 in the receiving opening 33 gradually reduces, while the tack-in force for blowing the weft yarn end section 32 into the shed of the warp yarns 13** gradually increases.

Figure 40:
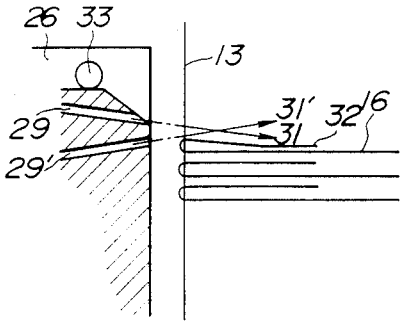

Accordingly, weft yarn end section 32 is bent at its base end portion 32*a* generally into the Z-shape as shown in FIG. 38. Thereafter, the tack-in operation changes through a state of FIG. 39 to a state of FIG. 40 in which the tip end portion 32*b* of the weft yarn end section 32 is blown into the shed of the warp yarns thereby completing the tack-in operation of the weft yarn end section 23. During this tack-in operation, the weft yarn end section 32 is bent back in a state in which the base end portion 32*a* is bent back in a state in which the base end portion 32*a* is close to the cloth fell 16 under a combination of the air jet from tack-in nozzle 29 and the air jet from tack-in nozzle 29', in which the force of combined air jets from the nozzles 29 and 29' is applied to further press the weft yarn end section tip end portion 32*b* onto the cloth fell 16. As a result, the weft yarn end section 32 is tacked in such a manner that its tip end portion 32*b* is positioned closer to the cloth fell 16 than the base end portion 32*a* as shown in FIG. 40. The operation hereinafter will take place in a similar fashion as in the first embodiment.

Figure 41:
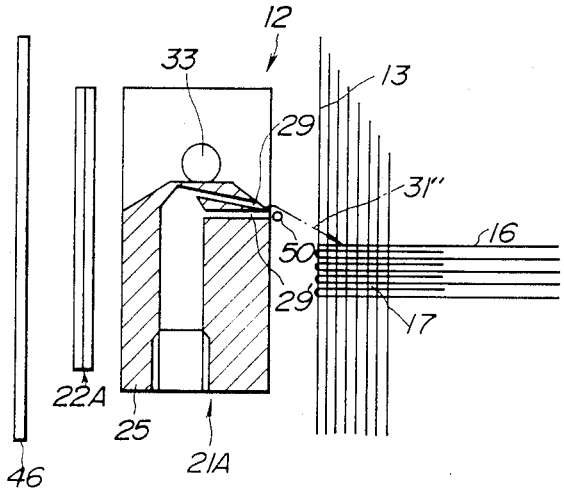
FIG. 41 is a plan view, partly in section, of an essential part of a tenth embodiment of the tack-in system according to the present invention.

FIG. 41 illustrates a tenth embodiment of the tack-in system 12 according to the present invention, which is similar to the ninth embodiment, with the exception that rod 50 having a circular cross-section is disposed close to the openings 29*a*, 29*a'* of the tack-in nozzles 29, 29' in order to adjust the direction of the fluid jet ejected from the tack-in nozzles 29, 29' under the Coanda effect due to rod 50. In this case, even if the axis of tack-in nozzle 29' is parallel with the cloth fell 16, the axis of the air stream produced upon a combination of air jets from tack-in nozzles 29, 29' is deflected toward the side of cloth fell 16 thereby crossing the cloth fell 16 at an acute angle as indicated by an arrow-headed dash-dot line 31''.

Figure 42:
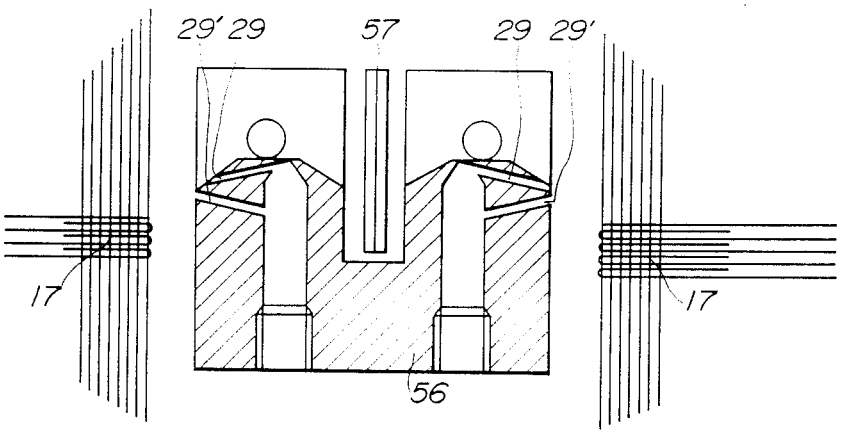
FIG. 42 is a plan view, partly in section, of an essential part of a modified example of the tack-in system of FIG. 33.

It will be understood that the arrangement in which the two tack-in nozzles 29 and 29' are used may be applied to the third embodiment of FIG. 13 though not shown, and to the fourth embodiment of FIG. 15 as shown in FIG. 42.

While a variety of embodiments have been shown and described hereinbefore, it will be appreciated that the following modifications may be made in the embodiments though not shown:

(1) The fluid to be ejected from the tack-in nozzle 29 (29') and/or from the weft holding nozzle opening 35 is not limited to air and therefore may be water, a mixture of water and air, and harmless gas or the like which can be selected as occasion demands.

(2) Although fluid receiving opening 33 for holding the weft yarn end section is adapted to draw therein the weft yarn end section under the action of fluid ejected therein from nozzle opening 35, the weft yarn end section may be drawn into the opening 33 under the action of suction air into the opening 33.

(3) The nozzle opening 35 and the receiving opening 33 for holding the weft yarn end section may be replaced with a mechanical weft yarn end holding device which is, for example, arranged to grasp the weft yarn end section 32 under the action of a spring material, in which grasping action of the device is released when the fluid is ejected from the tack-in nozzle 29, 29'.

(4) The fluid ejection nozzle 35 may always eject the fluid during loom operation.

(5) The nozzle opening 29*a*, 29*a'* of the tack-in nozzle 29, 29' may be formed elongated in one direction, in the T-shape, in the shape wherein two elongated openings cross each other, in the shape wherein one elongated opening crosses three parallel elongated openings, or in the shape including a plurality of small openings.

(6) The tack-in nozzle 29, 29' may be such adapted as to eject fluid jet onto the whole weft yarn end section 32.

(7) The body 25 of the tack-in nozzle device 21A, 21B may be provided with only nozzle 35 and the opening 33 for holding the weft yarn end section 32 while omitting the tack-in nozzles 29, 29', in which the thus constructed tack-in device body 25 is used in combination with a tack-in needle. Otherwise, the body 25 may be provided only with the tack-in nozzle 29, 29' while omitting nozzle 35 and the opening 33 for holding the weft yarn end section, in which the thus constructed body is used in combination with the other mechanical weft yarn end section holding device.

What is claimed is:

1. A tack-in system of a shuttleless loom having means for picking a weft yarn into a shed of warp yarns, said tack-in system comprising:

means defining a slit located near an edge of an array of the warp yarns, the weft yarn picked from the weft picking means being extended through said slit;

means for cutting the weft yarn picked from the weft picking means;

means for holding an end section of the picked and cut weft yarn having at least a part of said end section located within said slit, said end section projecting from an edge of a woven fabric;

means defining a fluid jet nozzle having an opening from which a fluid jet is ejected;

means for locating an opening of said nozzle such that the fluid jet therefrom blows the picked and cut weft yarn end section held by the holding means; and means for directing the fluid jet from said fluid jet nozzle so that an axis of the fluid jet crosses a cloth fell at an acute angle when projected on a horizontal plane passing through said cloth fell.

2. A tack-in system of a shuttleless loom having a weft inserting nozzle, comprising:

means defining a slit located near an edge of an array of warp yarns, a weft yarn picked from the weft inserting nozzle, said weft yarn extending through said slit;

means for cutting the weft yarn picked from the weft inserting nozzle;

means defining a weft holding opening communicating with said slit;

means for generating a stream of fluid through said weft holding opening in a direction away from said slit so as to hold an end section of the picked and cut weft yarn within said weft holding opening, said end section projecting from an edge of a woven fabric;

means defining a fluid jet nozzle having an opening from which a fluid jet is ejected, the opening of said nozzle merging in said slit; and means for directing the fluid jet from said fluid jet nozzle so that the end section of the picked and cut weft yarn is blown toward a cloth fell, crossing the cloth fell at an acute angle.

3. A tack-in system as claimed in claim 2, wherein said fluid stream generating means includes means for ejecting fluid into said weft holding opening.

4. A tack-in system as claimed in claim 2, further comprising means by which said fluid stream through said weft holding opening is generated prior to fluid jet ejection from said fluid jet nozzle.

5. A tack-in system as claimed in claim 2, wherein said weft holding opening is generally perpendicular to a horizontal plane passing through the cloth fell.

6. A tack-in system as claimed in claim 2, wherein said cutting means is located between the weft inserting nozzle and said slit defining means.

7. A tack-in system as claimed in claim 2, wherein said fluid jet nozzle has an axis whose extension crosses the cloth fell.

8. A tack-in system as claimed in claim 7, wherein said slit flatly extends in parallel with a horizontal plane passing through the cloth fell, said slit being so located that the weft yarn extending from the weft inserting nozzle to the edge of the warp yarn array is in said slit.

9. A tack-in system as claimed in claim 8, wherein said slit defining means includes first and second flat walls which are parallel with each other, and an end wall connecting said first and second flat walls, said end wall being located on a side of a reed relative to the cloth fell, the weft yarn connected between said weft inserting nozzle and the warp yarn array edge, said weft yarn entering said slit and reaching the end wall.

10. A tack-in system as claimed in claim 8, wherein said, fluid jet nozzle extends in a direction crossing the extension of said slit.

11. A tack-in system as claimed in claim 10, further comprising means for rotating a single unit in timed relation to a rotational angle of a loom main shaft so that said single unit takes a first position at which the weft yarn between the weft inserting nozzle and the edge of a warp yarn array enters said slit and a second position, at which said fluid jet nozzle is directed to a shed of warp yarns.

12. A tack-in system as claimed in claim 11, in which said fluid stream generating means includes means for communicating said slit with said fluid jet nozzle so that the weft yarn within said slit is drawn into said fluid jet nozzle.

13. A tack-in system as claimed in claim 12, further comprising means for preventing the weft yarn end section from being blown by the air jet from said fluid jet nozzle when said single unit takes said first position.

14. A tack-in system as claimed in claim 9, wherein said end wall includes a straight wall section extending generally parallel with the cloth fell, and an inclined wall section inclined relative to said straight wall section, said inclined wall section being located on a side of the warp yarn array relative to said straight wall section and having a first end contiguous with the straight wall section and a second end located between said straight wall section and the cloth fell in a direction of extension of the warp yarns.

15. A tack-in system as claimed in claim 14, wherein the opening of said fluid jet nozzle is formed in said end wall inclined wall section.

16. A tack-in system as claimed in claim 2, wherein said slit defining means, said weft holding opening defining means and said fluid stream generating means constitute a single unit disposed between the edge of the warp yarn array and said cutting means.

17. A tack-in system as claimed in claim 2, further comprising a fluid ejection nozzle opening located opposite to said weft holding opening with respect to said slit so that a fluid ejection stream from said fluid ejection nozzle flows through said slit into said weft holding opening.

18. A tack-in system as claimed in claim 17, further comprising means for controllably feeding fluid into said fluid ejection nozzle opening and into said fluid jet nozzle in timed relation to a rotational angle of a loom main shaft.

19. A tack-in system as claimed in claim 18, wherein said fluid feeding means includes a first valve through which fluid from a pressurized fluid source is fed to said fluid jet nozzle, and a second valve through which fluid from the pressurized fluid source is fed to said fluid ejection nozzle opening, and control means for initiating an opening of said first valve simultaneously with a closing of said second valve.

20. A tack-in system as claimed in claim 2, wherein the opening of said fluid jet nozzle is elongate so that a size in a direction of extension of the warp yarns is larger than a size in a direction perpendicular to the warp yarn array.

21. A tack-in system as claimed in claim 2, wherein the opening of said fluid jet nozzle includes a plurality of small openings aligned in a direction of extension of the warp yarns.

22. A tack-in system as claimed in claim 2, further comprising means for reducing the width of a tack selvage formed at the edge section of the woven fabric, said tack selvage width reducing means including a cutter disposed between said slit defining means and the edge of the warp yarn array so that the weft yarn end section extends from slit through said cutter to the warp yarn array edge.

23. A tack-in system as claimed in claim 2, wherein further comprising means for defining an auxiliary fluid jet nozzle disposed near said fluid jet nozzle, said auxiliary fluid jet nozzle having an opening from which the fluid jet is ejected, the axis of the fluid jet from said auxiliary fluid jet nozzle crosses the axis of the fluid jet from said fluid jet nozzle on a horizontal plan passing through the cloth fell.

* * * * *